US011721262B2

(12) United States Patent
Eom et al.

(10) Patent No.: US 11,721,262 B2
(45) Date of Patent: Aug. 8, 2023

(54) DISPLAY DRIVING CIRCUIT AND DISPLAY DEVICE INCLUDING THE SAME

(71) Applicant: Samsung Electronics Co., Ltd., Suwon-si (KR)

(72) Inventors: Jeeyeon Eom, Hwaseong-si (KR); Jeonghoon Choi, Hwaseong-si (KR); Yeongshin Jang, Gwacheon-si (KR); Youngbae Moon, Seongnam-si (KR); Woonyoung Lee, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/745,246

(22) Filed: May 16, 2022

(65) Prior Publication Data

US 2022/0383790 A1 Dec. 1, 2022

(30) Foreign Application Priority Data

May 25, 2021 (KR) ..... 10-2021-0066980

(51) Int. Cl.
*G09G 3/20* (2006.01)

(52) U.S. Cl.
CPC ..... *G09G 3/20* (2013.01); *G09G 2300/0413* (2013.01); *G09G 2310/0286* (2013.01); *G09G 2310/0289* (2013.01); *G09G 2310/0291* (2013.01); *G09G 2330/08* (2013.01)

(58) Field of Classification Search
None
See application file for complete search history.

(56) References Cited

U.S. PATENT DOCUMENTS

| | | | | |
|---|---|---|---|---|
| 9,625,779 | B2 | 4/2017 | Wang et al. | |
| 9,916,796 | B2 | 3/2018 | Ko et al. | |
| 10,930,199 | B2 | 2/2021 | Ahn | |
| 2008/0018636 | A1 | 1/2008 | Chang | |
| 2014/0043375 | A1* | 2/2014 | Hu | G09G 3/36 345/204 |
| 2017/0076665 | A1* | 3/2017 | Kim | G09G 3/3275 |

FOREIGN PATENT DOCUMENTS

| | | | |
|---|---|---|---|
| JP | 2010-081255 | A | 4/2010 |
| KR | 101205769 | B1 | 11/2012 |
| KR | 101241761 | B1 | 3/2013 |
| KR | 10-2020-0012060 | A | 2/2020 |
| KR | 102103609 | B1 | 4/2020 |

* cited by examiner

*Primary Examiner* — Christopher J Kohlman
(74) *Attorney, Agent, or Firm* — Harness, Dickey & Pierce, P.L.C.

(57) ABSTRACT

Provided is a display driving circuit including a plurality of source channels configured to provide data voltages to a plurality of data lines of a display panel, respectively; a dummy channel on one side of at least one of the source channels; and control logic configured to control operations of the source channels and the dummy channel, wherein, when failure of a first source channel from among the source channels is determined, the control logic is further configured to provide data voltages to data lines corresponding to the first source channel and second source channels, respectively, which are between the first source channel and the dummy channel, by using the second source channels and the dummy channel.

20 Claims, 15 Drawing Sheets

DISPLAY DRIVING CIRCUIT AND DISPLAY DEVICE INCLUDING THE SAME

CROSS-REFERENCE TO RELATED APPLICATION

This application is based on and claims priority under 35 U.S.C. § 119 to Korean Patent Application No. 10-2021-0066980, filed on May 25, 2021, in the Korean Intellectual Property Office, the disclosure of which is incorporated by reference herein in its entirety.

BACKGROUND

The inventive concepts relate to a display driving circuit and a display device including the same, and more particularly, to a display driving circuit that, when a defect of a source channel is identified, provides data voltages to data lines respectively corresponding to source channels by using another source channel and a dummy channel, and a display device including the display driving circuit.

A display device includes a display panel for displaying images and a display driving circuit for driving the display panel. The display driving circuit may drive the display panel by receiving image data from the outside (externally) and sending an image signal corresponding to received image data to data lines of the display panel.

A source channel of the display driving circuit may output an image signal to the display panel through a data line corresponding to the source channel. When some source channels are defective and the display panel is driven by using defective source channels, abnormal image signals may be output to the display panel. In some example embodiments, vertical fault lines may occur in the display panel.

SUMMARY

The inventive concepts provide a display driving circuit that, when a defect of a source channel is detected, provides data voltages to data lines corresponding to source channels, respectively by using a dummy channel and source channels between the dummy channel and a defective source channel, and a display device including the display driving circuit.

According to an aspect of the inventive concepts, there is provided a display driving circuit including a plurality of source channels configured to provide data voltages to a plurality of data lines of a display panel; a dummy channel on one side of at least one of the source channels; and control logic configured to control operations of the source channels and the dummy channel, wherein, when failure of a first source channel from among the source channels is determined, the control logic provides data voltages to data lines corresponding to the first source channel and second source channels, respectively, which are between the first source channel and the dummy channel, by using the second source channels and the dummy channel.

According to another aspect of the inventive concepts, there is provided a display driving circuit including a plurality of source channels in groups of N to be divided into source groups comprising N source channels, respectively; a plurality of dummy channels in groups of 'N to be divided into dummy groups comprising N dummy channels, respectively; switching devices connected between source channels of the source group and channels of adjacent groups corresponding to the source channels of the source group, respectively; and control logic configured to, when at least one of the source channels is defective, provide data voltages to data lines corresponding to source channels of a first source group, respectively including a defective source channel through output paths passing through at least some of channels of a group adjacent to the first source group by turning on the switching devices connected to the source channels of the first source group, respectively.

According to another aspect of the inventive concepts, there is provided a display device including a display panel; and a display driving circuit configured to drive the display panel to display images on the display panel, wherein the display driving circuit includes a plurality of source channels configured to provide data voltages to a plurality of data lines of the display panel; a dummy channel on one side of at least one of the source channels; and control logic configured to control operations of the source channels and the dummy channel, and, when failure of a first source channel from among the source channels is determined, the control logic provides data voltages to data lines corresponding to the first source channel and second source channels, respectively, which are between the first source channel and the dummy channel, by using the second source channels and the dummy channel.

BRIEF DESCRIPTION OF THE DRAWINGS

Example embodiments of the inventive concepts will be more clearly understood from the following detailed description taken in conjunction with the accompanying drawings in which.

DETAILED DESCRIPTION OF EXAMPLE EMBODIMENTS

Figure 1:
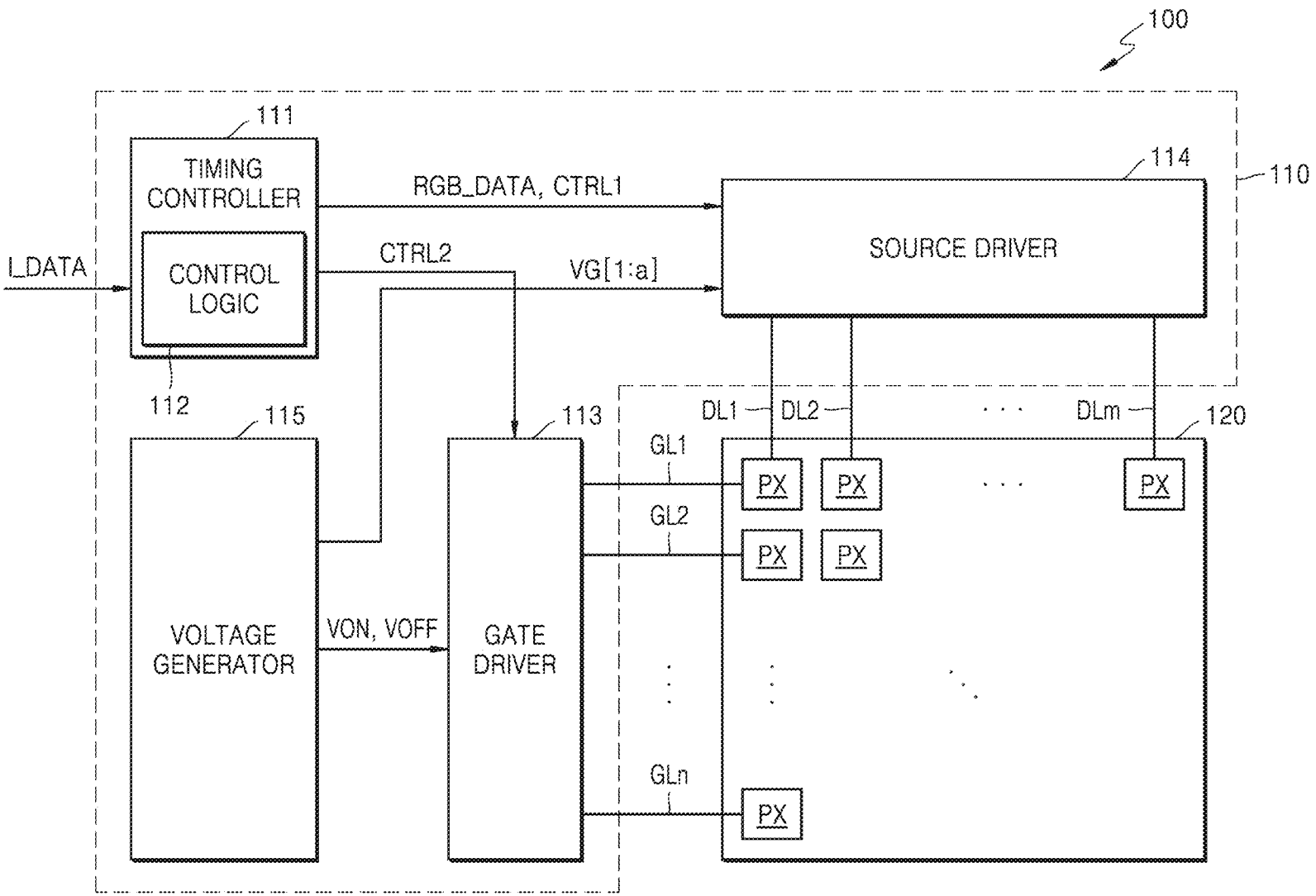
FIG. 1 is a block diagram showing a display device according to example embodiments of the inventive concepts.

FIG. 1 is a block diagram showing a display device 100 according to example embodiments of the inventive concepts.

Referring to FIG. 1, the display device 100 includes a display panel 120 that displays an image and a display driving circuit 110. The display device 100 according to example embodiments of the inventive concepts may be mounted on an electronic device having an image display function. For example, the electronic device may include smartphones, tablet personal computers (PCs), portable multimedia players (PMPs), cameras, wearable devices, televisions, digital video disk (DVD) players, refrigerators, air conditioners, air cleaners, set-top boxes, robots, drones, various medical devices, navigation devices, global positioning system (GPS) receivers, vehicle devices, furniture, or various measuring devices.

The display panel 120 is a display unit on which an image is actually displayed and may be any one of display devices that receives electrically transmitted image signals and displays 2-dimensional images, e.g., an organic light-emitting diode (OLED) display, a thin film transistor-liquid crystal display (TFT-LCD), a field emission display, a plasma display panel (PDP), etc. However, the inventive concepts are not limited thereto, and the display panel 120 may be implemented as a different type flat-panel display or a flexible display panel.

The display panel 120 may include a plurality of gate lines GL1 to GLn, a plurality of data lines DL1 to DLm arranged in a direction intersecting with the gate lines GL1 to GLn, and/or a plurality of pixels PX arranged in regions where the gate lines GL1 to GLn intersect with the data lines DL1 to DLm.

For example, when the display panel 120 is a TFT-LCD, each pixel PX may include a thin-film transistor of which a gate electrode and a source electrode are connected to a gate line and a data line, respectively, a liquid crystal capacitor connected to a drain electrode of the thin-film transistor, and a storage capacitor. Also, when a particular gate line is selected from among the gate lines GL1 to GLn, thin-film transistors of pixels PX connected to a selected gate line are turned ON, and then data voltages may be applied to the data lines DL1 to DLm by a source driver 114, respectively. A data voltage is applied to a liquid crystal capacitor and a storage capacitor through a thin-film transistor of a corresponding pixel PX, and an image may be displayed as the liquid crystal capacitor and the storage capacitor are driven.

The display panel 120 includes a plurality of horizontal lines (or rows), wherein one horizontal line includes pixels PX connected to one gate line. For example, pixels PX of a first row connected to a first gate line GL1 may constitute a first horizontal line, and pixels PX of a second row connected to a second gate line GL2 may constitute a second horizontal line.

During a horizontal line time, pixels PX of one horizontal line may be driven, and, during a next horizontal line time, pixels PX of another horizontal line may be driven. For example, during a first horizontal line time, the pixels PX of the first horizontal line corresponding to the first gate line GL1 may be driven, and then, during a second horizontal line time, the pixels PX of the second horizontal line corresponding to the second gate line GL2 may be driven. In this regard, during first to n-th horizontal line times, the pixels PX of the display panel 120 may be driven.

The display driving circuit 110 may include a timing controller 111, the source driver 114, a gate driver 113, and/or a voltage generator 115. The display driving circuit 110 may convert image data I_DATA received from the outside (externally) into a plurality of analog signals for driving the display panel 120, e.g., a plurality of data voltages, and supply the analog signals to the display panel 120.

The source driver 114 may include m source channels in correspondence to m data lines DL1 to DLm and output data voltages for driving the display panel 120 through the m source channels. The data voltages are signals provided to drive the pixels PX of one gate line of the display panel 120 and, as data voltages are output respectively to m gate lines GL1 to GLm, one frame is implemented on the display panel 120. The source channels of the source driver 114 may convert pixel data RGB_DATA received from the timing controller 111 into a plurality of image signals, e.g., a plurality of data voltages, and output the data voltages to the display panel 120 through the data lines DL1 to DLm. The pixel data RGB_DATA received from the timing controller 111 may include pixel data RGB_DATA corresponding to the source channels, respectively.

For example, the source channels of the source driver 114 may receive corresponding pixel data RGB_DATA, respectively. In other words, the source driver 114 may receive pixel data RGB_DATA in units of data corresponding to a plurality of pixels PX included in one horizontal line of the display panel 120.

The source channels may receive pixel data RGB_DATA corresponding to the respective source channels from the timing controller 111 based on a plurality of grayscale voltages VG[1:a] (or gamma voltages) received from the voltage generator 115 and convert the pixel data RGB_DATA into data voltages.

The source driver 114 may output the data voltages to the display panel 120 in units of horizontal lines through the data lines DL1 to DLm. For example, the source channels may output a plurality of data voltages corresponding to a plurality of pixels PX included in a first horizontal line of the display panel 120 and then output a plurality of data voltages corresponding to a plurality of pixels PX included in a second horizontal line.

A dummy channel (not shown) may be disposed on one side surface of at least one of the source channels. The dummy channel may be included in the source driver 114. However, the inventive concepts are not limited thereto, and the dummy channel may be provided on one side surface of the source driver 114 separately from the source driver 114. When one of the source channels is defective, the dummy channel may be used to replace a defective source channel to provide data voltages to the data lines DL1 to DLm corresponding to the source channels. The data lines DL1 to DLm corresponding to the source channels may refer to data lines connected to the source channels.

The dummy channel may convert pixel data RGB_DATA received from the timing controller 111 into image signals, e.g., data voltages, and output the data voltages to the display panel 120 via the data lines DL1 to DLm corresponding to a source channel adjacent to the dummy channel. The pixel data RGB_DATA received from the timing controller 111 may include dummy pixel data corresponding to the dummy channel.

The gate driver 113 is connected to a plurality of gate lines GL1 to GLn of the display panel 120 and may sequentially drive the gate lines GL1 to GLn of the display panel 120. The gate driver 113 may sequentially provide a plurality of gate on signals having an active level, e.g., logic high, to the gate lines GL1 to GLn under the control of the timing controller 111. Therefore, the gate lines GL1 to GLn may be sequentially selected, and, a plurality of data voltages may be applied to pixels PX of a horizontal line corresponding to a selected gate line through the data lines DL1 to DLm.

The timing controller 111 may control the overall operation of the display driving circuit 110. For example, the timing controller 111 may control components of the display driving circuit 110, e.g., the source driver 114 and the gate driver 113, to display image data I_DATA received from the outside (externally) on the display panel 120.

For example, the timing controller 111 may generate pixel data RGB_DATA by converting the format of received image data I_DATA to comply with the interface specification with the source driver 114 and output the pixel data RGB_DATA to the source driver 114. Also, the timing controller 111 may generate various control signals including a first control signal CTRL1 and a second control signal CTRL2 for controlling the timings of the source driver 114 and the gate driver 113. The timing controller 111 may output a first control signal CTRL1 to the source driver 114 and output a second control signal CTRL2 to the gate driver 113. Here, the first control signal CTRL1 may include a polarity control signal and may include controls signals for controlling the operations of a plurality of source channels and a plurality of dummy channels. Also, the second control signal CTRL2 may include a gate timing signal.

The timing controller 111 may include a control logic 112. The control logic 112 may determine failure of one of a plurality of source channels of the source driver 114 and control the operations of the source channels and a plurality of dummy channels according to a result of the determination. The control logic 112 may generate a control signal for controlling the operations of the source channels and the dummy channels based on the result of the determination and provide the control signal to the source driver 114 as the first control signal CTRL1. The operations of the source channels and the dummy channels may be controlled based on the first control signal CTRL1. When the dummy channels are not included in the source driver 114, the control logic 112 may provide the first control signal CTRL1 to the source driver 114 and the dummy channels.

When failure of a first source channel from among the source channels is determined, the control logic 112 may generate a control signal including signals for controlling to provide data voltages to data lines respectively corresponding to the first source channel and a second source channel, which is between the first source channel and a dummy channel, by using the second source channel and the dummy channel.

In example embodiments, when failure of the first source channel is determined, the control logic 112 may generate a control signal for providing data voltages to data lines respectively corresponding to the first source channel and the second source channel through output paths passing through at least some of channels adjacent respectively to the first source channel and the second source channel. By passing through at least some of channels adjacent to the first source channel instead of the first source channel, a normal data voltage may be provided to a data line corresponding to the first source channel.

Although FIG. 1 shows that the control logic 112 is provided inside the timing controller 111, the inventive concepts are not limited thereto, and the control logic 112 may be a circuit separate from the timing controller 111. Here, the control logic 112 may provide a control signal for controlling the operation of the source driver 114 to the source driver 114 as a separate control signal from the first control signal CTRL1 provided from the timing controller 111. According to example embodiments, the control logic 112 may be provided in the source driver 114.

The voltage generator 115 may generate various voltages needed for driving the display device 100. For example, the voltage generator 115 may receive a power voltage from the outside (externally). Also, the voltage generator 115 may generate a plurality of grayscale voltages VG[1:a] and output the same to the source driver 114. Also, the voltage generator 115 may generate a gate on voltage VON and a gate off voltage VOFF and output the same to the gate driver 113.

The display driving circuit 110 according to the inventive concepts may include additional components. For example, the display driving circuit 110 may be implemented to include a memory (not shown) for storing received image data I_DATA frame by frame.

In the present example embodiments, the gate driver 113, the source driver 114, and the timing controller 111 are shown as functional blocks different from one another. In example embodiments, components, e.g. the gate driver 113, the source driver 114, and the timing controller 111 may be implemented as different semiconductor chips from one another. In other example embodiments, at least two from among the gate driver 113, the source driver 114, and the timing controller 111 may be implemented as one semiconductor chip. For example, the source driver 114 and the timing controller 111 may be integrated on single semiconductor chip. Also, some components may be integrated on the display panel 120. For example, the gate driver 113 may be integrated on the display panel 120.

Figure 2:
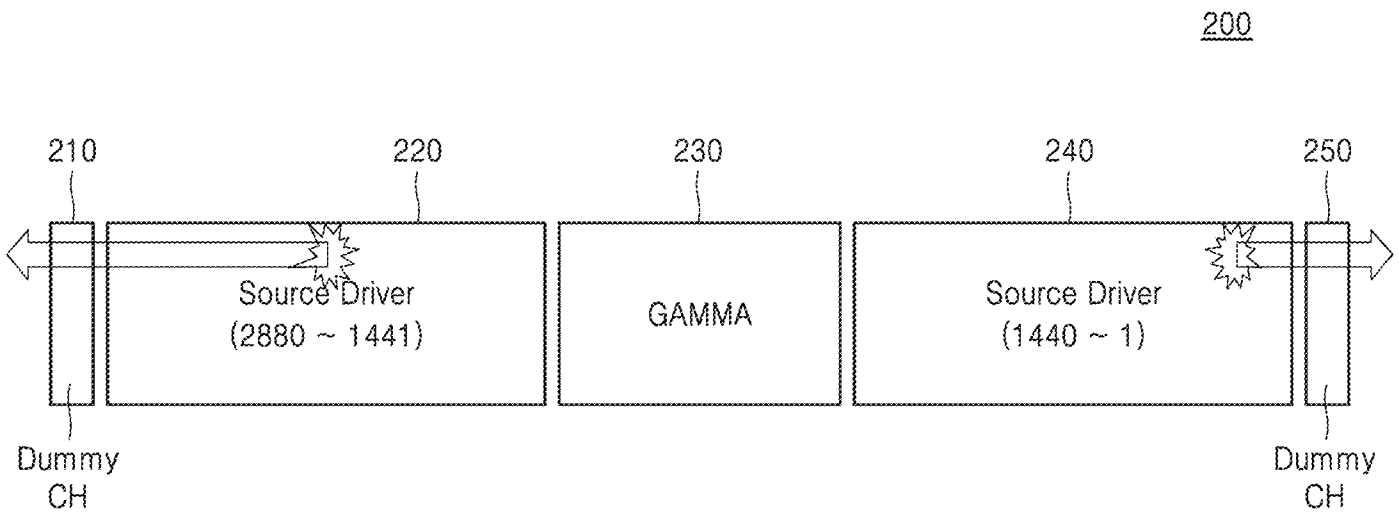
FIG. 2 is a diagram showing a configuration of a display driving circuit according to example embodiments of the inventive concepts.

FIG. 2 is a diagram showing the configuration of a display driving circuit 200 according to example embodiments of the inventive concepts.

Referring to FIG. 2, the display driving circuit 200 may include source drivers 220 and 240, a gamma channel 230, and/or dummy channels 210 and 250. The display driving circuit 200 and the source drivers 220 and 240 of FIG. 2 correspond to the display driving circuit 110 and the source driver 114 of FIG. 1, and the dummy channels 210 and 250 of FIG. 2 correspond to the dummy channel described above with reference to FIG. 1. Therefore, descriptions identical to those given above will be omitted below.

The dummy channels 210 and 250 may be arranged on one side of the source drivers 220 and 240. The dummy channels 210 and 250 may be arranged on the left side of the source drivers 220 and 240, on the right side of the source drivers 220 and 240, or on the left side and the right side of the source drivers 220 and 240. For example, a dummy channel 210 may be disposed on the left side of a source driver 220, and a dummy channel 250 may be disposed on the right side of a source driver 240. In another example, the dummy channel 210 may be disposed on the left side of the source driver 220, and the dummy channel 250 may be disposed on the right side of the source driver 220.

The dummy channels 210 and 250 may each include a plurality of dummy channels. For example, five dummy channels may be disposed on the left side of the source driver 220, and the other five dummy channels may be disposed on the right side of the source driver 240.

As shown in FIG. 2, the dummy channels 210 and 250 may be arranged on one side of the source drivers 220 and 240 as separate components from the source drivers 220 and 240. However, the inventive concepts are not limited thereto, and the dummy channels 210 and 250 may be arranged on one side of at least one of a plurality of source channels in the source drivers 220 and 240. The dummy channels 210 and 250 may be arranged on one side of a plurality of source channels. The source drivers 220 and 240 may include a plurality of source channels, and a plurality of source channel include in each of the source drivers 220 and 240 may be successively arranged. In example embodiments, the dummy channels 210 and 250 may be arranged on one side of source channels successively arranged in the source drivers 220 and 240. For example, referring to FIG. 2, the dummy channel 250 may be disposed adjacent to the rightmost source channel from among 1440 source channels that are successively arranged. Also, the dummy channels 210 and 250 may be arranged between source channels. For example, the dummy channel 250 may be disposed between a source channel 1 and a source channel 2.

The gamma channel 230 may transmit a driving voltage, which is generated by a voltage generator to drive source drivers, to the source drivers 220 and 240. The gamma channel 230 may be disposed between the source driver 220 and the source driver 240. The source driver 220 and the source driver 240 may receive the same driving voltage from the gamma channel 230 and output the driving voltage.

When a first source channel from among a plurality of source channels is defective, data voltages may be provided to data lines respectively corresponding to the first source channel and the second source channels by using second source channels, which is arranged between the first source channel and a dummy channel, and the dummy channel. For example, referring to FIG. 2, when 1440 source channels from a source channel 1 to a source channel 1440 are successively arranged in the leftward direction, the dummy channel 250 is disposed adjacent to the source channel 1, and a source channel 4 is defective and corresponds to the first source channel, data voltages may be provided to data lines corresponding to source channels 1 to 4 by using the dummy channel 250, a source channel 3, a source channel 2, and the source channel 1. Although FIG. 2 shows that the source drivers 220 and 240 each include 1440 source channels, the number of source channels is not necessarily limited thereto.

As the dummy channels 210 and 250 are arranged on one side of a plurality of source channels and data voltages are provided to data lines by using second source channels and the dummy channels 210 and 250, the location of an output pad connected to the data lines corresponding to the source channels may not be changed. Also, when data voltages are provided to data lines by using second source channels and a dummy channel, increase in a distance between a source channel and an output pad may be reduced or minimized. Therefore, data voltages not significantly different from data voltages provided to data lines when there is no defective source channel from among a plurality of source channels may be provided.

Figure 3:
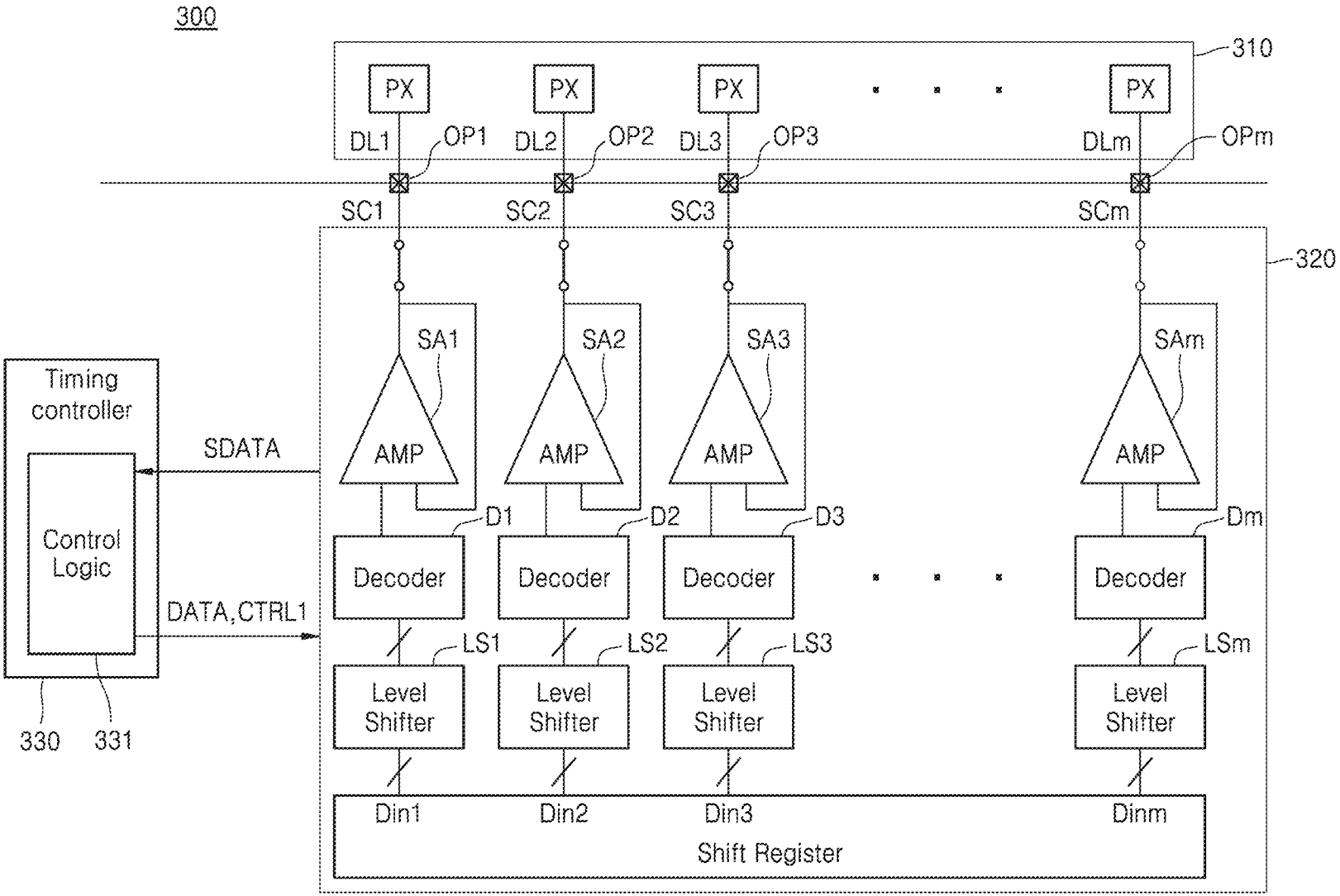
FIG. 3 is a diagram for describing a configuration of a source channel according to example embodiments.

FIG. 3 is a diagram for describing the configuration of a source channel according to example embodiments.

Referring to FIG. 3, a display device 300 may include a display panel 310, a source driver 320, and/or a timing controller 330. The source driver 320 may include a plurality of source channels SC1 to SCm and a shift register. Since the source driver 320 of FIG. 3 corresponds to the source drivers 220 and 240 of FIG. 2 and the display device 300, the display panel 310, and the timing controller 330 of FIG. 3 correspond to the display device 100, the display panel 120, and the timing controller 111 of FIG. 1, descriptions identical to those given above will be omitted below.

The source driver 320 may include a shift register. The shift register may provide pixel data Din1 to Dinm to the source channels SC1 to SCm, respectively. The shift register may store image data DATA, e.g., pixel data for one line, provided from the timing controller 330 and output pixel data for one line based on a vertical synchronization signal or a timing signal generated based on a vertical synchronization signal. The shift register may output the pixel data Din1 to Dinm. The shift register may provide the pixel data Din1 to Dinm respectively corresponding to m source channels SC1 to SCm to the source channels SC1 to SCm. For example, the shift register may provide pixel data Din1 corresponding to a source channel SC1 to the source channel SC1. In another example, the shift register may provide pixel data Dinm corresponding to a source channel SCm to the source channel SCm.

The m source channels SC1 to SCm may each include a level shifter, a decoder, and/or an amplifier. For example, the source channel SC1 may include a level shifter LS1, a decoder D1, and an amplifier SA1, and a source channel SC2 may include a level shifter LS2, a decoder D2, and an amplifier SA2.

A level shifter may provide a control signal by changing a voltage level of pixel data. A level shifter may receive pixel data corresponding to each source channel from a shift register, change a voltage level of received pixel data, and provide a control signal to a decoder of each channel. For example, the level shifter LS1 may receive pixel data Din1 corresponding to the source channel SC1 from the shift register, change a voltage level of the pixel data Din1, and provide a control signal to the decoder D1.

A decoder may select a grayscale voltage based on a control signal provided from a level shifter. A control signal provided from a level shifter is converted to a grayscale voltage by a decoder, and thus pixel signals corresponding to pixel data may be provided to an amplifier. For example, the decoder D1 may select a grayscale voltage corresponding to the pixel data Din1 corresponding to the source channel SC1 from among a plurality of grayscale voltages and output a selected grayscale voltage as a pixel signal. The decoder D1 may provide a pixel signal corresponding to the pixel data Din1 to the amplifier SAL In another example, the decoder D2 may select a grayscale voltage corresponding to pixel data Din2 corresponding to the source channel SC2 from among the grayscale voltages and output a selected grayscale voltage as a pixel signal. The decoder D2 may provide a pixel signal corresponding to the pixel data Din2 to the amplifier SA2.

An amplifier may amplify a selected grayscale voltage provided from a decoder. An amplifier may amplify a pixel signal output from a decoder and output a data voltage through an output pad. An amplifier may be referred to as a channel amplifier or a source amplifier. Since source channels are connected to output pads corresponding to the respective source channels and the output pads are connected to data lines corresponding to the respective output pads, an amplifier may provide a data voltage to a data line corresponding to a corresponding source channel. For example, the amplifier SA1 may amplify a pixel signal provided from the decoder D1 and output a data voltage through an output pad OP1 corresponding to the source channel SC1, thereby providing the data voltage to a data line DL1 corresponding to the output pad OP1.

In example embodiments, amplifiers SA1 to SAm of the respective source channels SC1 to SCm may provide data SDATA for determining whether the respective source channels SC1 to SCm are defective to the timing controller 330. For example, the amplifier SA1 may provide data SDATA for determining whether the source channel SC1 is defective to a control logic 331.

The control logic 331 may determine whether the source channel SC1 is defective from among the source channels SC1 to SCm based on an output of the amplifiers. The control logic 331 may determine whether the respective source channels SC1 to SCm are defective based on data SDATA output from the amplifiers SA1 to SAm. Data SDATA for determining whether a source channel is defective may be a data voltage of a corresponding source channel.

The control logic 331 may determine a source channel corresponding to a first source channel, which is defective, by comparing data SDATA with a pre-set voltage. A pre-set voltage may differ from one source channel to another. When data SDATA output from an amplifier of one source channel is higher than a pre-set voltage, the control logic 331 may determine that the corresponding source channel is defective. For example, when data SDATA output from an amplifier SA3 is higher than a pre-set voltage, the control logic 331 may determine a source channel SC3 as a first source channel. However, the inventive concepts are not limited thereto. When data SDATA output from an amplifier of one source channel is lower than a pre-set voltage, the control logic 331 may also determine the corresponding source channel as defective. For example, when data SDATA output from the amplifier SA1 is lower than a pre-set voltage, the control logic 331 may determine the source channel SC1 as a first source channel.

Figure 4:
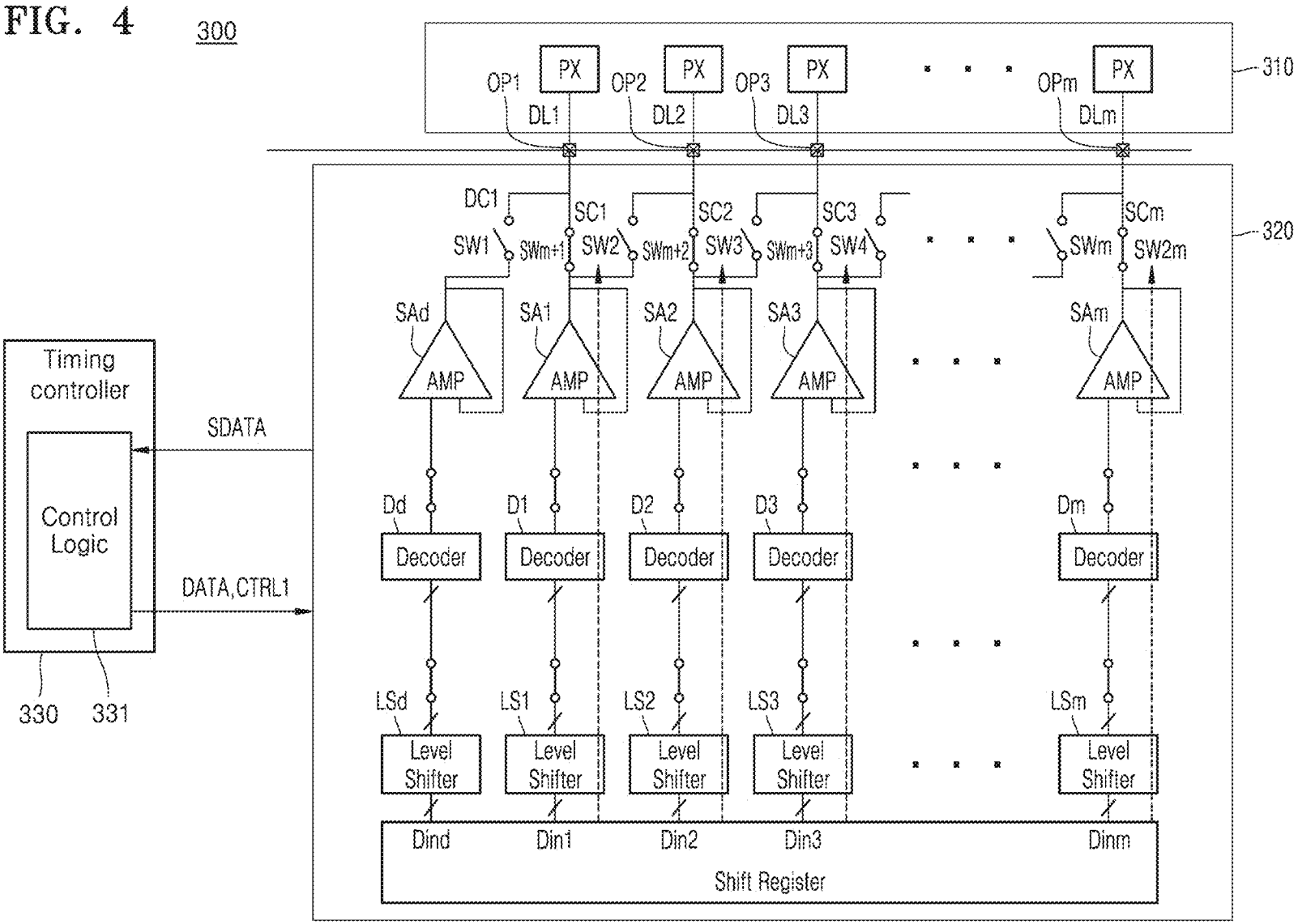
FIG. 4 is a diagram for describing a configuration of a dummy channel according to example embodiments.

FIG. 4 is a diagram for describing the configuration of a dummy channel according to example embodiments. For example, FIG. 4 is a diagram showing example embodiments in which a dummy channel is added to the source driver of FIG. 3.

Referring to FIG. 4, the source driver 320 may include a dummy channel DC1. The dummy channel DC1 may be disposed on one side of at least one of the source channels SC1 to SCm. The dummy channel DC1 may be disposed on one side of the source channels SC1 to SCm. For example, the dummy channel DC1 may be disposed adjacent to the source channel SC1. However, the inventive concepts are not limited thereto, and the dummy channel DC1 may be disposed adjacent to the source channel SCm.

The source channels SC1 to SCm and the dummy channel DC1 may be connected to nearby source channels from among the source channels SC1 to SCm. For example, the source channel SC2 may be connected to the source channel SC1 and the source channel SC3 that are adjacent to the source channel SC2. In another example, the dummy channel DC1 may be connected to the source channel SC1 adjacent to the dummy channel DC1. Source channels adjacent to the source channels SC1 to SCm and the dummy channel DC1 may be source channels that receive the same gamma voltages as the source channels SC1 to SCm and the dummy channel DC1 from a voltage generator. Source channels adjacent to the source channels SC1 to SCm and the dummy channel DC1 may receive the same gamma voltages from a voltage generator. For example, the source channel SC2 and the source channel SC3 adjacent to the source channel SC2 may receive the same gamma voltage.

In example embodiments, the source channels SC1 to SCm and the dummy channel DC1 may be connected to nearby source channels respectively through switching devices SW1 to SWm. For example, the source channel SC1 may be connected to the source channel SC2 adjacent to the source channel SC1 through a switching device SW2. In another example, the dummy channel DC1 may be connected to the source channel SC1 adjacent to the dummy channel DC1 through a switching device SW1.

The locations of the switching devices SW1 to SWm may vary according to components of the dummy channel DC1. In example embodiments, when the dummy channel DC1 includes a level shifter LSd, a decoder Dd, and/or an amplifier SAd, the switching devices SW1 to SWm may be connected between output pads OP1 to OPm and output ends of amplifiers SA1 to SAm and SAd included in channels adjacent to each of the source channels SC1 to SCm. For example, the switching device SW1 may be connected between the output pad OP1 connected to the source channel SC1 and an output end of the amplifier SAd included in the dummy channel DC1.

In other example embodiments, when the dummy channel DC1 includes the level shifter LSd and the decoder Dd as its components, the switching devices SW1 to SWm may be connected between inputs ends of the amplifiers SA1 to SAm included in the respective source channels SC1 to SCm and output ends of the decoders D1 to Dm and Dd included in channels adjacent to the respective source channels SC1 to SCm.

Also, the switching devices SW1 to SWm may be arranged for each of the source channels SC1 to SCm according to the components of the dummy channel DC1. In example embodiments, when the dummy channel DC1 includes the amplifier SAd as its component, the switching devices SW1 to SWm may include a first switching device connected between the output pads OP1 to OPm respectively connected to the source channels SC1 to SCm and output ends of amplifiers SA1 to SAm and SAd included in channels adjacent to the source channels SC1 to SCm. Also, the switching devices SW1 to SWm may include a second switching device connected between output ends of the decoders D1 to Dm included in the respective source channels SC1 to SCm and input ends of the amplifiers SA1 to SAm and SAd included in channels adjacent to the source channels SC1 to SCm.

The shift register may be connected to the dummy channel DC1 and provide dummy pixel data Dind corresponding to the dummy channel DC1 to the dummy channel DC1. Dummy pixel data is an arbitrary signal data that may not affect driving of the data lines DL1 to DLm.

In example embodiments, the dummy channel DC1 may include at least one of a level shifter, a decoder, and/or an amplifier. For example, the dummy channel DC1 may include the level shifter LSd, the decoder Dd, and/or the amplifier SAd. In another example, the dummy channel DC1 may include the level shifter LSd and the decoder Dd. Although FIG. 4 shows only one dummy channel DC1, there may be a plurality of dummy channels, and each dummy channel may include at least one of a level shifter, a decoder, and an amplifier.

The control logic 331 may control the operations of the source channels SC1 to SCm and the dummy channel DC1. The control logic 331 may determine failure of a first source channel from among the source channels SC1 to SCm based on data SDATA output from the amplifiers SA1 to SAm and control the operations of the source channels SC1 to SCm and the dummy channel DC1 based on a result of the determination. The control logic 331 may provide the first control signal CTRL1 including signals for controlling the operations of the source channels SC1 to SCm and the dummy channel DC1 to the dummy channel DC1 and the source channels SC1 to SCm.

When there is no first source channel, which is defective, from among the source channels SC1 to SCm, the control logic 331 may provide data voltages to the data lines DL1 to DLm respectively corresponding to the source channels SC1 to SCm without using the dummy channel DC1. The pixel data Din1 to Dinm may be provided to the data lines DL1 to DLm through output paths of the respective source channels SC1 to SCm. In other words, the pixel data Din1 to Dinm may move along dotted arrows. The output paths may refer to paths in which the pixel data Din1 to Dinm move to the output pads OP1 to OPm respectively corresponding to the pixel data Din1 to Dinm. The output paths may be controlled based on the first control signal CTRL1.

The control logic 331 may control the output paths by using the switching devices SW1 to SWm. For example, when there is no first source channel, which is defective, from among the source channels SC1 to SCm, the control logic 331 may control the switching devices SW1 to SWm to maintain a turn-off state and control switching devices SWm+1 to SW2*m* to maintain a turn-on state.

When failure of a first source channel is determined from among the source channels SC1 to SCm, data voltages may be provided to the data lines DL1 to DLm by using source channels adjacent to the first source channel and the dummy channel DC1 instead of the first source channel. Detailed descriptions thereof will be given below with reference to FIG. 5.

Figure 5:
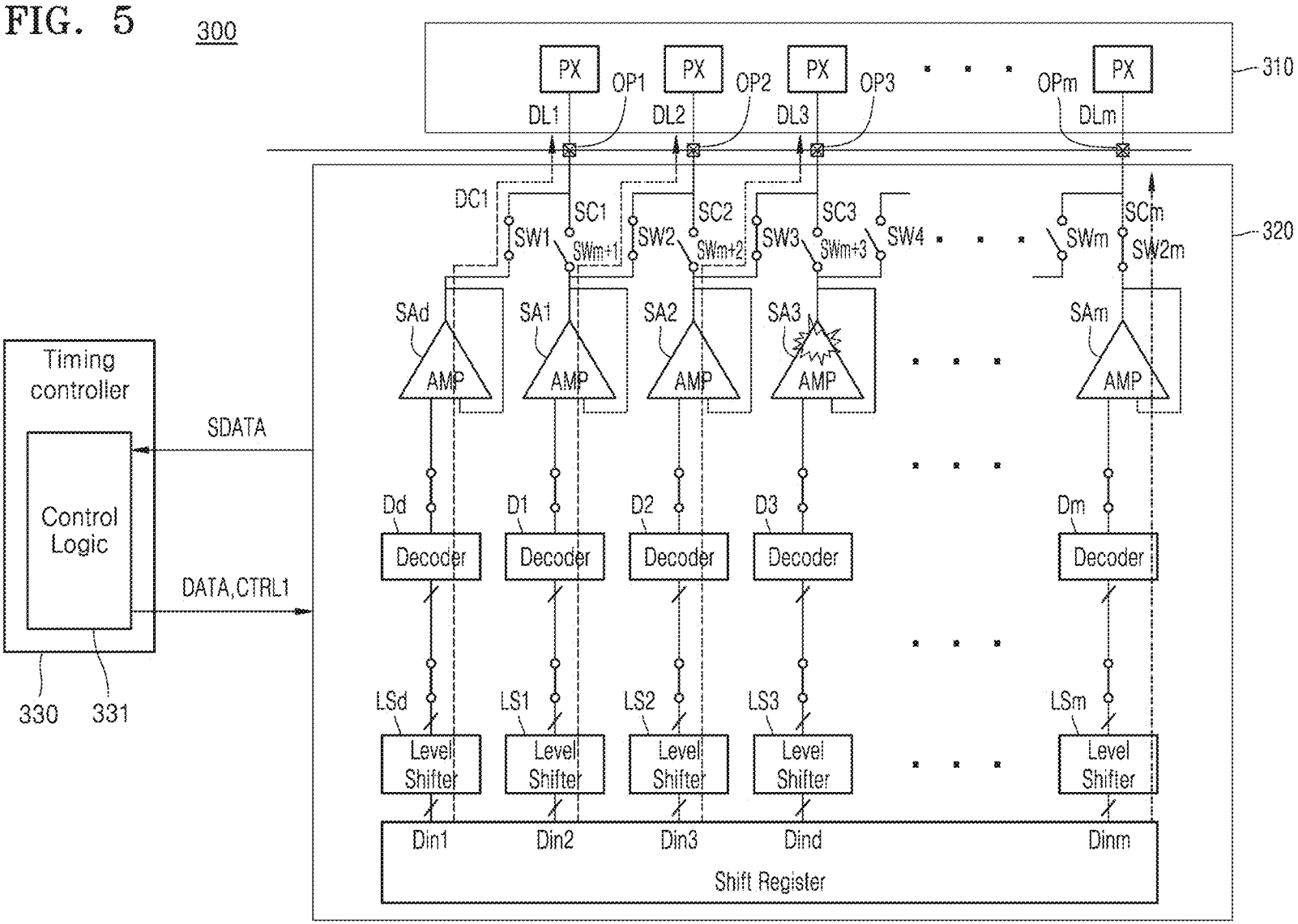
FIG. 5 is a diagram for describing a method of providing data voltages when a source channel failure occurs, according to example embodiments.

FIG. 5 is a diagram for describing a method of providing data voltages when a source channel failure occurs, according to example embodiments.

FIG. 5 shows example embodiments where failure of a first source channel from among a plurality of source channels is determined. The first source channel may refer to a defective source channel from among a plurality of source channels, and a second source channel may refer to a source channel disposed between the first source channel and a dummy channel. Referring to FIG. 5, the control logic 331 may determine whether the respective source channels SC1 to SCm are defective based on data SDATA output from the amplifiers SA1 to SAm. For example, when the amplifier SA3 is defective, the control logic 331 may determine failure of the source channel SC3 based on data SDATA, which is an output of the amplifier SA3.

When failure of the first source channel from among the source channels SC1 to SCm is determined by the control logic 331, the shift register may provide pixel data respectively corresponding to the first source channel and the second source channel to channels adjacent to the first source channel and the second source channel. For example, when the control logic 331 determines that the source channel SC3 corresponds to the first source channel and is defective, the shift register may provide pixel data Din3, Din2, and Din1 to channels adjacent to source channels SC3, SC2, and SC1 in a direction toward the dummy channel DC1, respectively. In other words, the shift register may provide pixel data Din3 to the source channel SC2, provide the pixel data Din2 to the source channel SC1, and provide the pixel data Din1 to the dummy channel DC1.

When failure of the first source channel is determined from among the source channels SC1 to SCm by the control logic 331, the shift register may provide the dummy pixel data Dind to the first source channel. When the dummy channel DC1 is connected to the shift register and failure of the first source channel is determined, the dummy pixel data Dind may be provided to the first source channel. For example, when the control logic 331 determines that the source channel SC3 corresponds to the first source channel and is defective, the shift register may provide the dummy pixel data Dind to the source channel SC3.

When failure of a first source channel from among the source channels SC1 to SCm is determined, the control logic 331 may provide data voltages to data lines respectively corresponding to the first source channel and a second source channel, which is between the first source channel and the dummy channel DC1, by using the second source channel and the dummy channel DC1. When failure of the source channel SC3 is determined, the control logic 331 may provide data voltages to data lines DL3, DL2, and DL1 respectively corresponding to the source channel SC3, which is the first source channel, and second source channels SC2 and SC1 by using the second source channels SC2 and SC1, which are arranged between the source channel SC3 and the dummy channel DC1, and the dummy channel DC1. For example, when failure of the source channel SC3, which is a first source channel, is determined, the control logic 331 may provide the pixel data Din3 provided from the shift register to a data line DL3 corresponding to the source channel SC3 as a data voltage by using the source channel SC2, which is a second source channel. When failure of the source channel SC3, which is a first source channel, is determined, the control logic 331 may provide the pixel data Din2 provided from the shift register to a data line DL2 corresponding to the source channel SC2 as a data voltage by using the source channel SC1, which is a second source channel. Also, when failure of the source channel SC3, which is a first source channel, is determined, the control logic 331 may provide the pixel data Din1 provided from the shift register to the data line DL1 corresponding to the source channel SC1, which is a second source channel, as a data voltage by using the dummy channel DC1.

When failure of the first source channel is determined, the control logic 331 may provide data voltages to data lines respectively corresponding to the first source channel and the second source channel through output paths passing through at least some of channels adjacent to the first source channel and the second source channel. The control logic 331 may provide data voltages by using all or some of channels adjacent respectively to a first source channel and second source channels.

In example embodiments, when failure of a first source channel from among a plurality of source channels is determined, the control logic 331 may provide data voltages to data lines respectively corresponding to the first source channel and second source channels by using at least one of level shifters, decoders, and amplifiers of the second source channels and a dummy channel. For example, when failure of the source channel SC3, which is a first source channel, is determined, the control logic 331 may generate a data voltage by using the level shifter LS2, the decoder D2, and the amplifier SA2 of the source channel SC2, which is a second source channel, and output the data voltage through an output pad OP3 connected to a switching device SW3, thereby providing the data voltage to the data line DL3. The control logic 331 may generate a data voltage by using the level shifter LS1, the decoder D1, and the amplifier SA1 of the source channel SC1, which is a second source channel, and output the data voltage through an output pad OP2 connected to the switching device SW2, thereby providing the data voltage to the data line DL2. The control logic 331 may generate a data voltage by using the level shifter LSd, the decoder Dd, and the amplifier SAd of the dummy channel DC1 and output the data voltage through the output pad OP1 connected to the switching device SW1, thereby providing the data voltage to the data line DL1.

The level shifter LSd may receive the pixel data Din1 from the shift register, transform the voltage level of the pixel data Din1, and provide a control signal to the decoder Dd. The decoder Dd may select a grayscale voltage corresponding to the pixel data Din1 from among a plurality of grayscale voltages and output a selected grayscale voltage as a pixel signal. The amplifier SAd may generate a data voltage by amplifying a pixel signal provided from the decoder Dd, output the data voltage through the output pad OP1 connected to the switching device SW1, and provide the data voltage to the data line DL1. However, the inventive concepts are not necessarily limited thereto, and the control logic 331 may use level shifters and decoders of second source channels and a dummy channel or may use amplifiers thereof only. Detailed descriptions thereof will be given later with reference to FIG. 6.

When failure of a first source channel is determined, the control logic 331 may control an output path by using the switching devices SW1 to SWm. For example, when failure of the source channel SC3, which is a first source channel, from among the source channels SC1 to SCm is determined, the control logic 331 may switch switching devices SW1 to SW3 to the turn-on state, switch switching devices SWm+1 to SWm+3 to the turn-off state, maintain switching devices SW4 to SWm in the turn-off state, and maintain switching devices SWm+4 to SW2*m* in the turn-on state, thereby controlling an output path.

Figure 6:
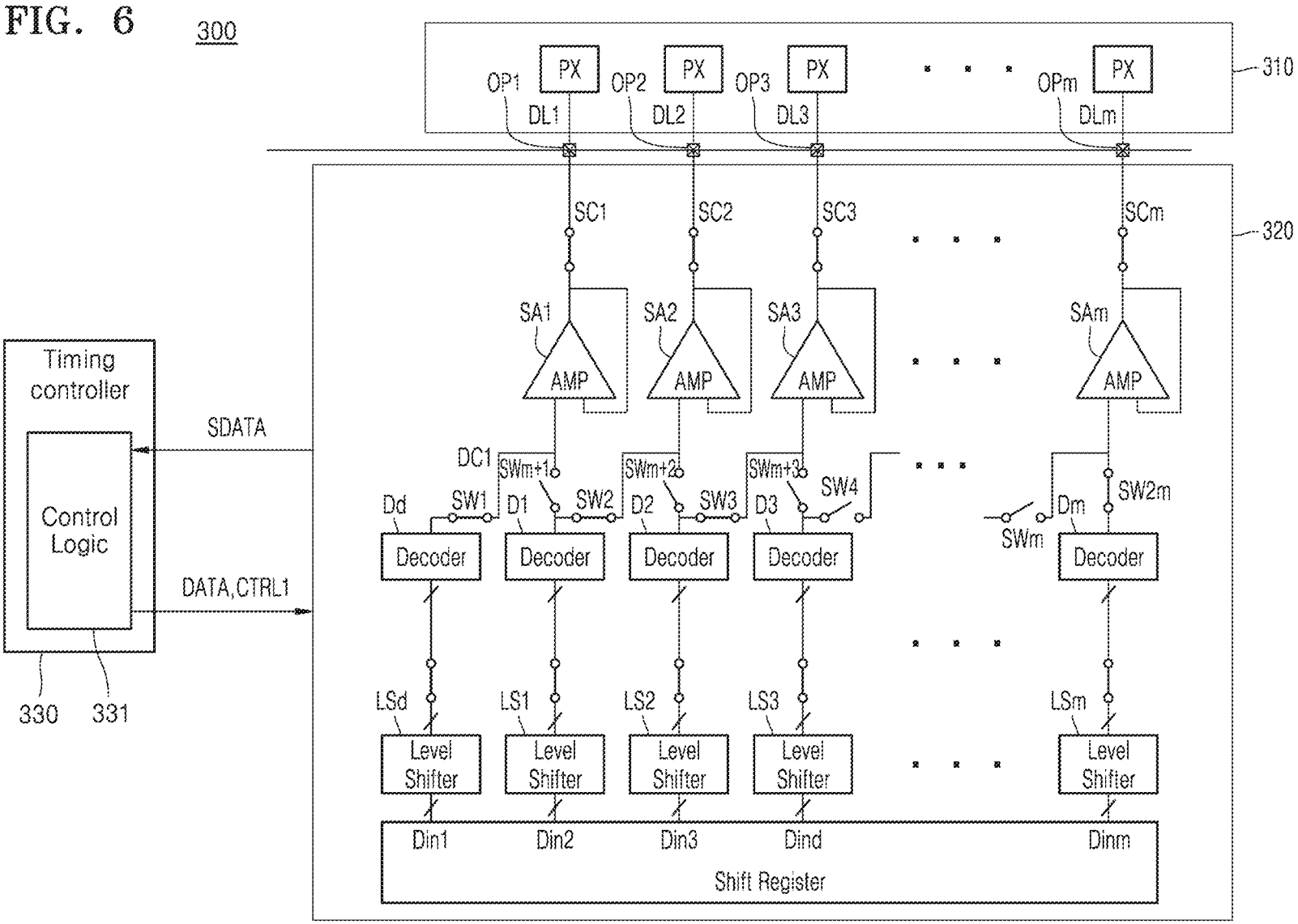
FIG. 6 is a diagram for describing a method of providing data voltages when a source channel failure occurs, according to other example embodiments.

FIG. 6 is a diagram for describing a method of providing data voltages when a source channel failure occurs, according to other example embodiments.

FIG. 6 shows example embodiments where a component different from the dummy channel DC1 of FIG. 5 is provided. Referring to FIG. 6, the dummy channel DC1 may include the decoder Dd and the level shifter LSd. The source channels SC1 to SCm and the dummy channel DC1 may be connected to nearby source channels from among the source channels SC1 to SCm.

The source channels SC1 to SCm and the dummy channel DC1 may be connected to nearby source channels through switching devices SW1 to SWm. When the dummy channel DC1 includes the level shifter LSd and the decoder Dd as its components, the switching devices SW1 to SWm may be connected between inputs ends of the amplifiers SA1 to SAm included in the respective source channels SC1 to SCm and output ends of the decoders D1 to Dm and Dd included in channels adjacent to the respective source channels SC1 to SCm. For example, the switching device SW1 may be connected between an input end of the amplifier SA1 included in the source channel SC1 and an output end of the decoder Dd included in the dummy channel DC1 adjacent to the source channel SC1.

The control logic 331 may determine whether the respective source channels SC1 to SCm are defective based on data SDATA output from the amplifiers SA1 to SAm. For example, when a decoder D3 is defective, the control logic 331 may determine failure of the source channel SC3 based on data SDATA, which is an output of the amplifier SA3.

When failure of a first source channel from among a plurality of source channels is determined, the control logic 331 may provide data voltages to data lines respectively corresponding to the first source channel and second source channels by using at least one of level shifters and decoders of the second source channels and a dummy channel. For example, When failure of the source channel SC3, which is a first source channel, is determined, the control logic 331 may generate a pixel signal corresponding to the pixel data Din3 by using the level shifter LS2 and the decoder D2 of the source channel SC2, which is a second source channel, provide a generated pixel signal to the amplifier SA3 through the switching device SW3, generate a pixel signal corresponding to the pixel data Din2 by using the level shifter LS1 and the decoder D1 of the source channel SC1, which is a second source channel, provide a generated pixel signal to the amplifier SA2 through the switching device SW2, generate a pixel signal corresponding to the pixel data Din1 by using the level shifter LSd and the decoder Dd of the dummy channel DC1 and provide a generated pixel signal to the amplifier SA1 through the switching device SW1. The amplifier SA1 may output a data voltage through the output pad OP1 by amplifying a pixel signal provided from the decoder Dd and provide the data voltage to the data line DL1.

When failure of a first source channel is determined, the control logic 331 may control an output path by using the switching devices SW1 to SWm. For example, when failure of the source channel SC3, which is a first source channel, from among the source channels SC1 to SCm is determined, the control logic 331 may control the switching devices SW1 to SW3 and the switching devices SWm+4 to SW2*m* to be in the turn-on state and control the switching devices SWm+1 to SWm+3 and the switching devices SW4 to SWm to be in the turn-off state, thereby controlling an output path.

Figure 7:
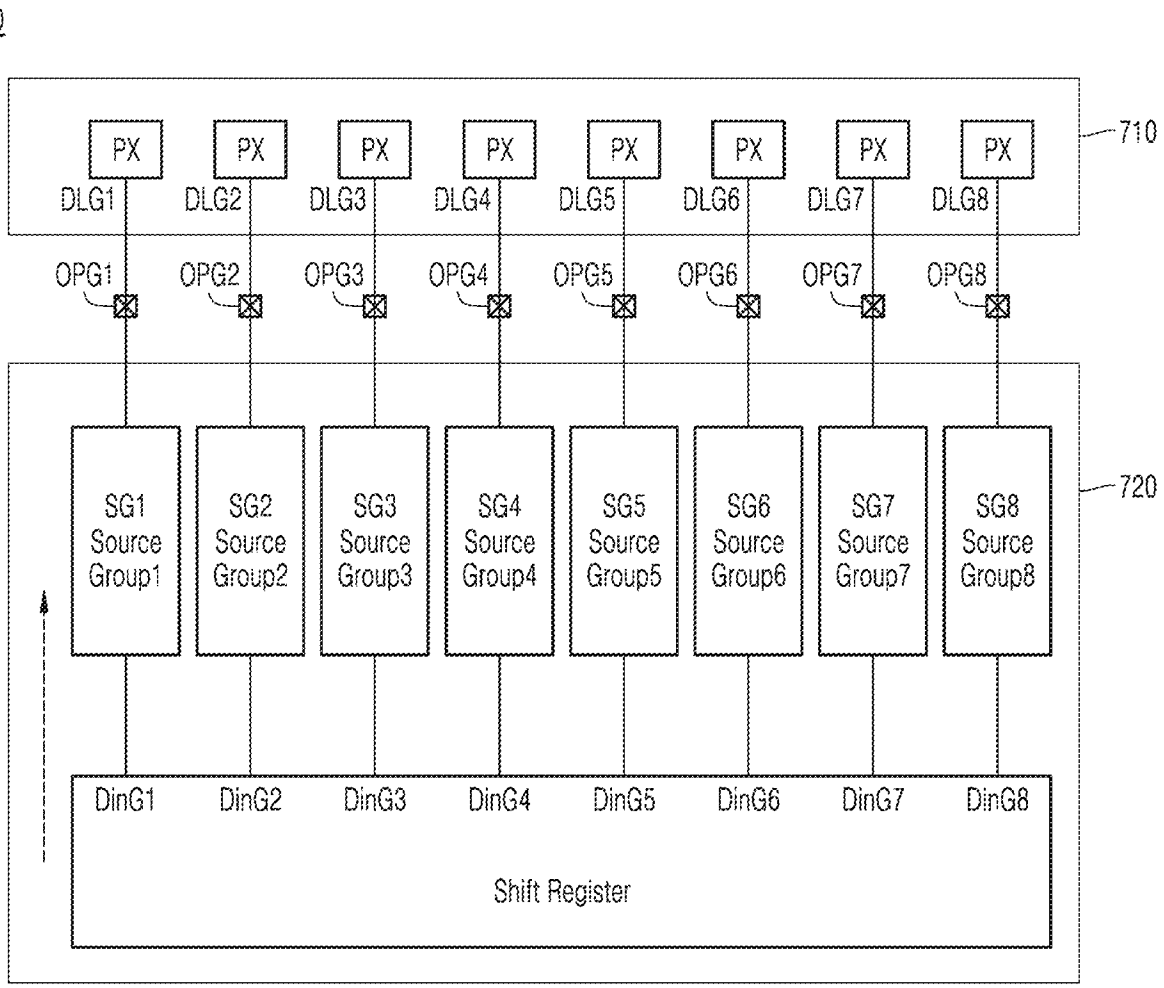
FIG. 7 is a diagram showing source groups according to example embodiments.

FIG. 7 is a diagram showing source groups according to example embodiments.

Referring to FIG. 7, a source driver 720 may include a plurality of source groups SG1 to SG8. Although FIG. 7 shows eight source groups SG1 to SG8, the number of source groups may be greater than or less than eight. Since a display device 700, a display panel 710, and/or the source driver 720 are identical to those described above, descriptions identical to those given above will be omitted below.

A plurality of source channels may be grouped into the source groups SG1 to SG8 each including N (N is a positive number) source channels. In other words, one source group may include N source channels.

A shift register may provide pixel data groups DinG1 to DinG8 to the source groups SG1 to SG8, respectively. One pixel data group may include pixel data corresponding to N channels included in a source group corresponding to the pixel data group. For example, the shift register may provide a pixel data group DinG1 to a source group SG1 and provide pixel data corresponding to N channels of the source group SG1 to the N channels of the source group SG1, respectively.

The source groups SG1 to SG8 may convert pixel data groups DinG1 to DinG8 respectively corresponding to the source groups SG1 to SG8 to data voltages, output the data voltages through output pad groups OPG1 to OPG8 respectively corresponding to the source groups SG1 to SG8, and provide the data voltages to data line groups DLG1 to DLG8 respectively corresponding to the output pad groups OPG1 to OPG8. One output pad group may include output pads respectively corresponding to N channels of a corresponding source group, and one data line group may include data lines respectively corresponding to N channels of a corresponding source group.

Figure 8:
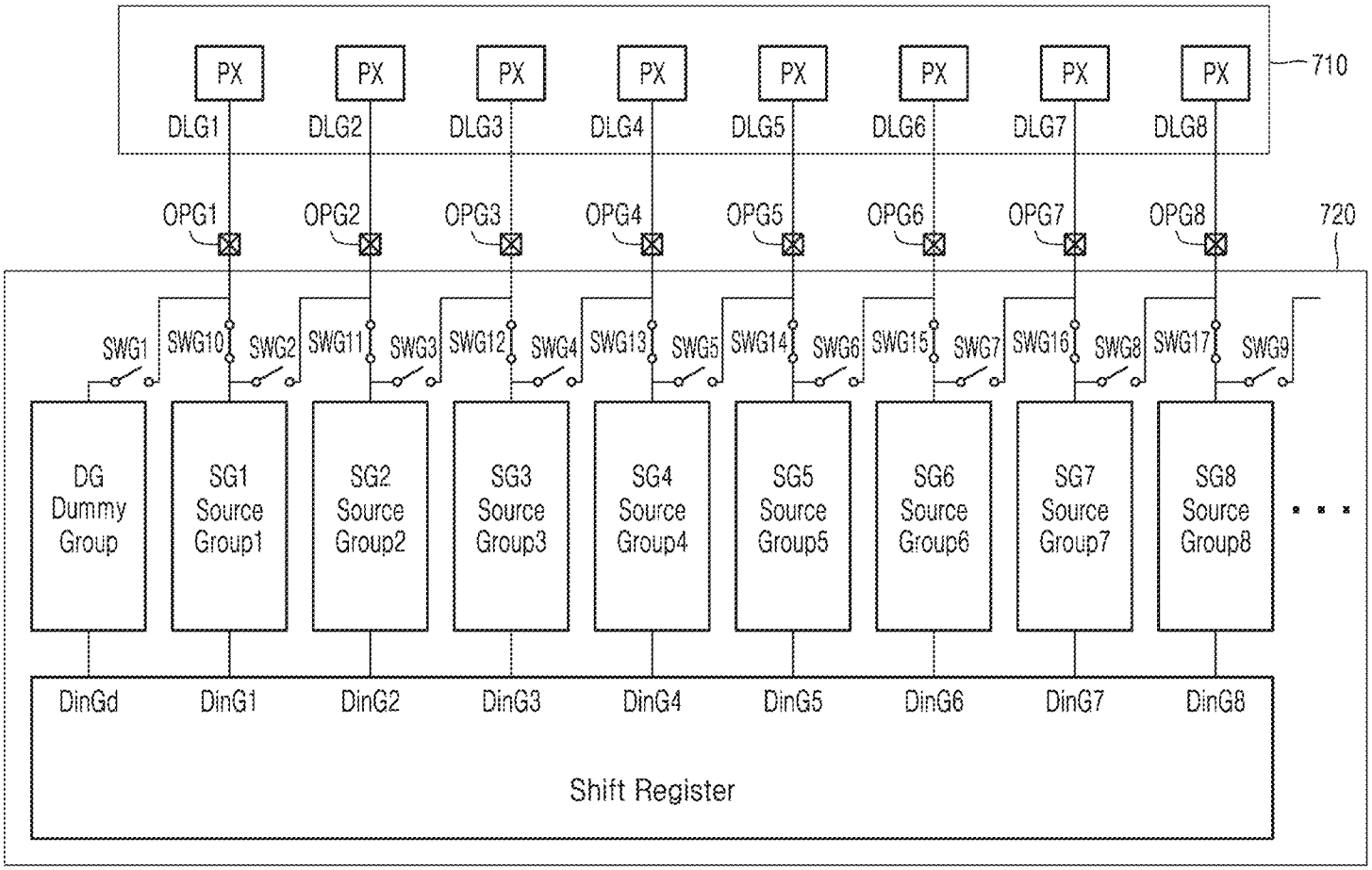
FIG. 8 is a diagram showing dummy groups according to example embodiments.

FIG. 8 is a diagram showing dummy groups according to example embodiments. For example, FIG. 8 shows example embodiments in which a dummy group is added to FIG. 7.

Referring to FIG. 8, the source driver 720 may include a dummy group DG. The dummy group DG may include N dummy channels. The dummy group DG may be disposed on one side of at least one of the source groups SG1 to SG8. For example, the dummy group DG may be disposed adjacent to the source group SG1. However, the inventive concepts are not necessarily limited thereto. The dummy group DG may be disposed adjacent to a source group SG8. The dummy group DG may be disposed between a source group SG3 and a source group SG4. Alternatively, there may be a plurality of dummy groups DG, and the dummy groups DG may be arranged adjacent to the source group SG1 and the source group SG8.

In example embodiments, the source groups SG1 to SG8 and the dummy group DG may each include four channels and may include at least one of a red channel, a blue channel, a first green channel, and a second green channel. For example, the source groups SG1 to SG8 and the dummy group DG may each include a red channel, a blue channel, a first green channel, and a second green channel. However, the inventive concepts are not limited to the above-stated types of channels.

N source channels and dummy channels of the source groups SG1 to SG8 and the dummy group DG may be connected to N source channels of groups adjacent to the source groups SG1 to SG8 and the dummy group DG respectively. For example, N source channels of the source group SG1 may be connected to N source channels of a source group SG2 adjacent to the source group SG1, respectively. In another example, N dummy channels of the dummy group DG may be connected to N source channels of the source group SG1 adjacent to the dummy group DG, respectively. N source channels and dummy channels of the source groups SG1 to SG8 and the dummy group DG may be connected to N source channels of groups adjacent to the source groups SG1 to SG8 and the dummy group DG receiving the same gamma voltages as the N source channels and the dummy channels of the source groups SG1 to SG8 and the dummy group DG. For example, a source channel 1 of the source group SG1 may be connected to a source channel 5 of the source group SG2, wherein the source channel 1 and the source channel 5 may receive the same gamma voltage. The number of dummy channels included in a dummy group may be determined based on a set of gamma voltages. For example, a dummy group may include four dummy channels respectively receiving four gamma voltages.

N channels included in each source group and a dummy group may correspond to one another. For example, a red channel, a blue channel, a first green channel, and a second green channel included in the dummy group DG may correspond to a red channel, a blue channel, a first green channel, and a second green channel of the source group SG1, respectively, and the red channel, the blue channel, the first green channel, and the second green channel of the source group SG1 may correspond to a red channel, a blue channel, a first green channel, and a second green channel of the source group SG2, red channel.

In example embodiments, the source groups SG1 to SG8 and the dummy group DG may be connected to adjacent source groups through switching device groups SWG1 to SWG9. One switching device group may include N switching devices for connecting N channels included in each of the source groups SG1 to SG8 and the dummy group DG to N channels of an adjacent source group, respectively. For example, source channels included in the source group SG2 may be connected to source channels of the source group SG3 adjacent thereto through N switching devices of a switching device group SWG3. In another example, dummy channels included in the dummy group DG may be connected to source channels of the source group SG1 adjacent thereto through N switching devices of a switching device group SWG1 respectively.

The shift register may be connected to the dummy group DG and provide dummy pixel data group DinGd corresponding to the dummy group DG to the dummy group DG. The dummy pixel data group DinGd may include dummy pixel data corresponding to N channels included in the dummy group DG corresponding to the dummy pixel data group DinGd. For example, the shift register may provide dummy pixel data corresponding to N dummy channels of the dummy group DG to the N dummy channels of the dummy group DG, respectively.

A control logic (e.g., the control logic 331 of FIG. 4) may control the operations of the source groups SG1 to SG8 and the dummy group DG. The control logic may determine failure of a first source channel from among the source channels SC1 to SCm based on data SDATA output from amplifiers of source channels included in the source groups SG1 to SG8 and control the operations of the source groups SG1 to SG8 and the dummy group DG based on a result of the determination. The control logic may provide a signal for controlling the operations of the source groups SG1 to SG8 and the dummy group DG to the source groups SG1 to SG8 and the dummy group DG as a first control signal CTRL1.

When there is no first source channel, which is defective, from among a plurality of source channels included in the source groups SG1 to SG8, the control logic may provide data voltages to the data line groups DLG1 to DLG8 respectively corresponding to the source groups SG1 to SG8 without using the dummy group DG.

The control logic may control an output path by using the switching device groups SWG1 to SWG9. For example, when there is no first source channel, which is defective, from among a plurality of source channels, the control logic may control switching devices included in the switching device groups SWG1 to SWG9 to maintain the turn-off state and control switching devices included in switching device groups SWG10 to SWG17 to maintain the turn-on state, thereby controlling an output path.

Figure 9:
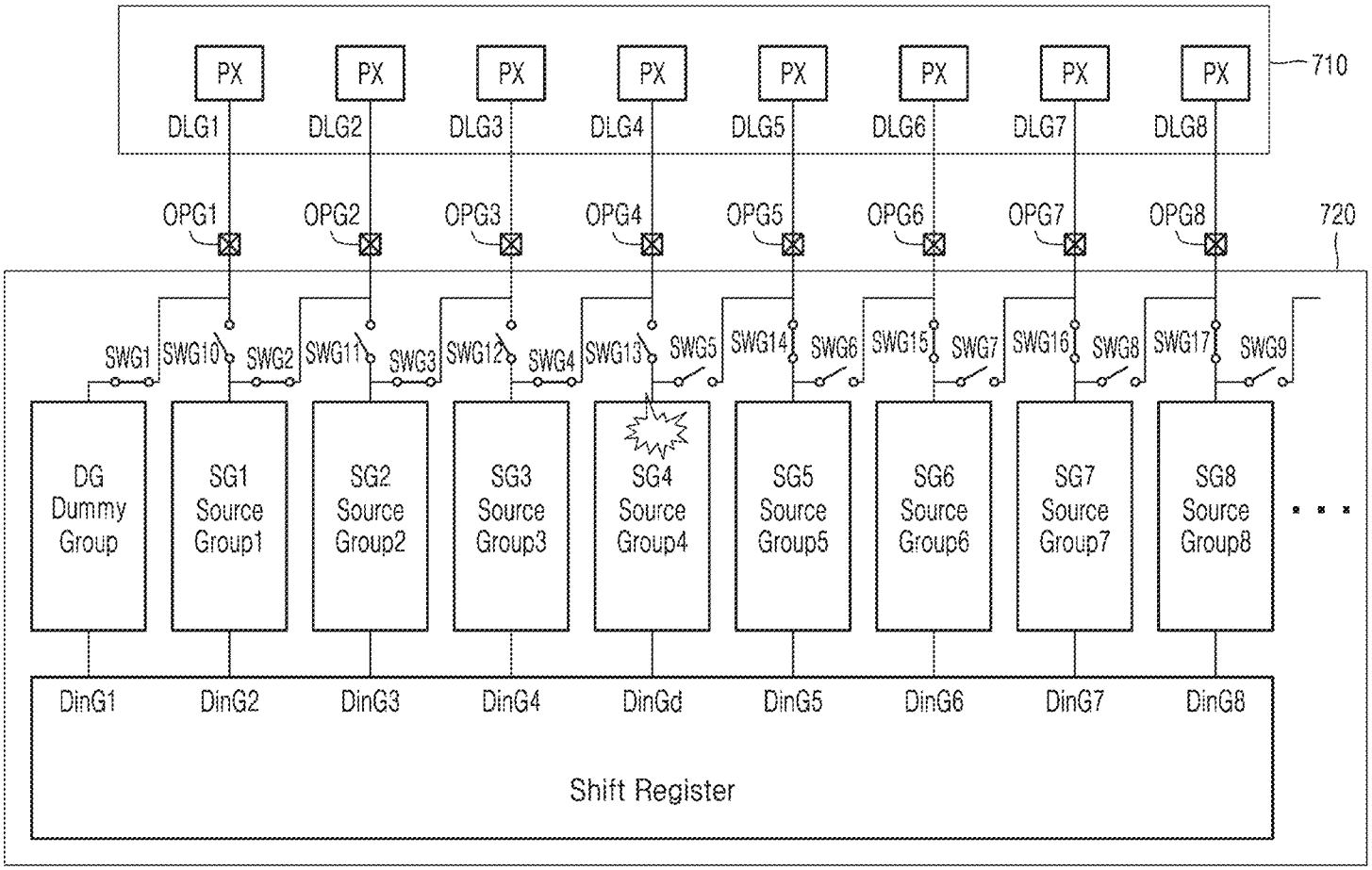
FIG. 9 is a diagram showing a first source group including a first source channel according to example embodiments.

FIG. 9 is a diagram showing a first source group including a first source channel according to example embodiments. FIG. 9 shows example embodiments where failure of a first source channel included in a first source group from among the source groups SG1 to SG8 is determined.

Referring to FIG. 9, a control logic (e.g., the control logic 331 of FIG. 5) may determine whether each source channel is defective based on data SDATA output from amplifiers included in source channels of the source groups SG1 to SG8 and determine a first source group. The first source group may refer to a source group including the first source channel. For example, when the source group SG4 includes the first source channel, the source group SG4 may be the first source group.

When failure of a first source channel from among a plurality of source channels is determined by the control logic, a shift register may provide pixel data groups respectively corresponding to the first source group and second source groups arranged between the first source group and the dummy group DG to groups adjacent to the first source group and the second source groups. For example, when failure of the first source channel included in the source group SG4 is determined by the control logic, the shift register may provide pixel data groups DinG4, DinG3, DinG2, and DinG1 to groups adjacent to source groups SG4, SG3, SG2, and SG1 in a direction toward the dummy group DG, respectively. In other words, the shift register may provide a pixel data group DinG4 to the source group SG3, provide a pixel data group DinG3 to the source group SG2, provide a pixel data group DinG2 to the source group SG1, and provide the pixel data group DinG1 to the dummy group DG.

When failure of the first source channel is determined by the control logic, the shift register may provide the dummy pixel data group DinGd to the first source group. When the dummy group DG is connected to the shift register and failure of the first source channel is determined, the dummy pixel data group DinGd may be provided to the first source group. For example, the shift register may provide the dummy pixel data group DinGd to the source group SG4, which is the first source group.

When failure of the first source channel included in the first source group from among the source groups SG1 to SG8 is determined, the control logic may provide data voltages to data lines respectively corresponding to source channels of the first source group and the second source groups by using the second source groups and a dummy group. For example, when failure of the first source channel included in the source group SG4, which is the first source group, is determined, the control logic may provide data voltages to data lines respectively corresponding to source channels of the source group SG4 and source groups SG3, SG2, and SG1, which are second source groups, by using the source groups SG3, SG2, and SG1 and the dummy group DG.

When failure of the first source channel is determined, the control logic may provide data voltages to data lines respectively corresponding to source channels of the first source channel and the second source groups through output paths passing through at least portions of channels of groups adjacent to the first source group and the second source groups. The control logic may provide data voltages to data lines respectively corresponding to source channels of the source group SG4, which is a first source group, through an output path passing through channels included in the source group SG3, which is a second source group, respectively corresponding to the source channels of the source group SG4.

When failure of a first source channel is determined, the control logic 331 may control an output path by using the switching device groups SWG1 to SWG9. For example, when failure of the first source channel included in the source group SG4, which is the first source group, is determined, the control logic may control switching devices included in switching device groups SWG1 to SWG4 and switching device groups SWG14 to SWG17 to be in the turn-on state and switching devices included in switching device groups SWG10 to SWG13 and switching device groups SWG5 to SWG9 to be in the turn-off state, thereby controlling an output path.

Figure 10:
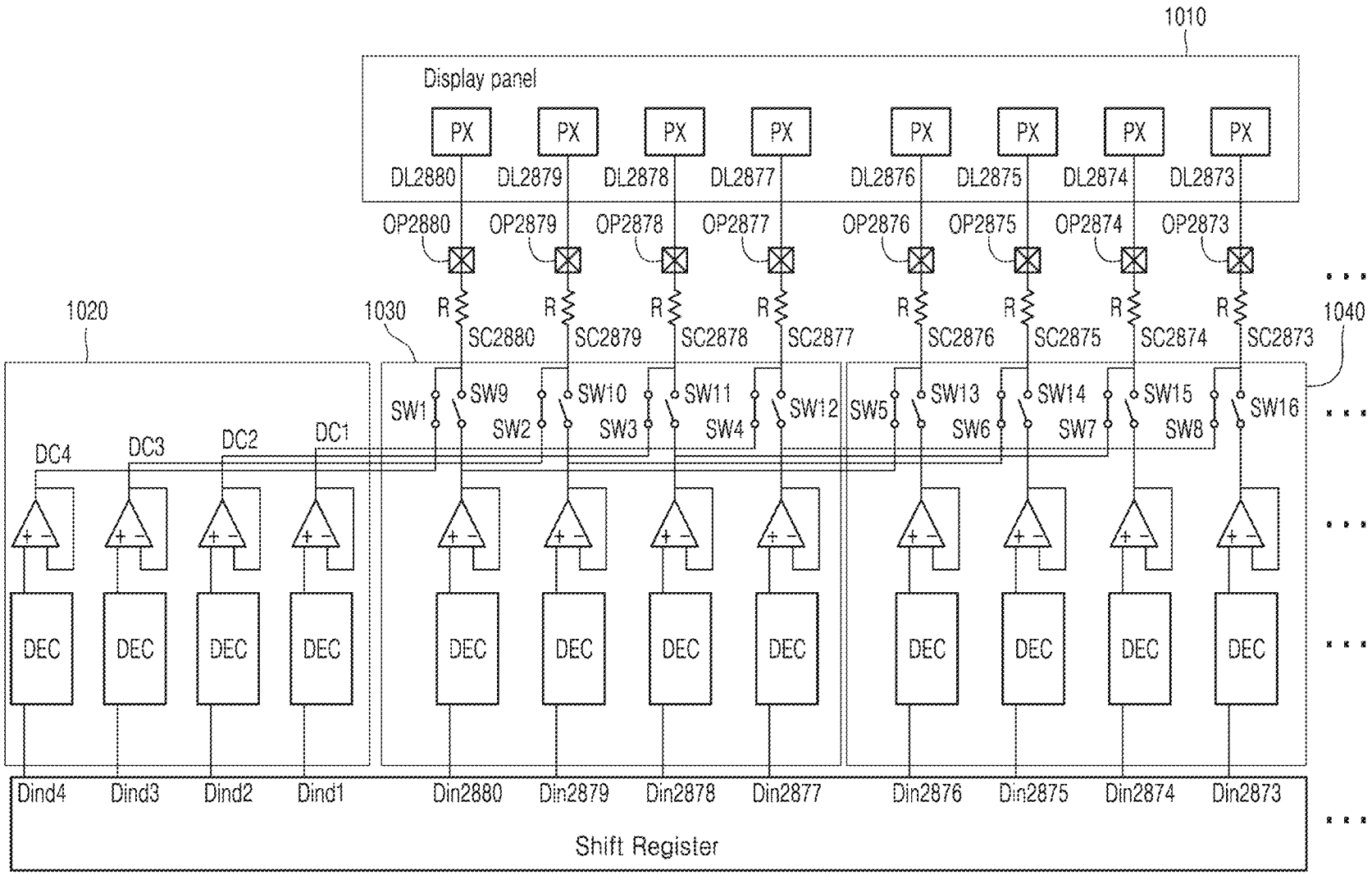
FIG. 10 is a diagram showing a source group and a dummy group according to example embodiments.

FIG. 10 is a diagram showing a source group and a dummy group according to example embodiments.

Referring to FIG. 10, a dummy group 1020 may include a plurality of dummy channels DC1 to DC4, a second source group 1030 may include a plurality of source channels SC2877 to SC2880, and a first source group 1040 may include a plurality of source channels SC2873 to SC2876. Although FIG. 10 shows that the dummy group 1020, the second source group 1030, and the first source group 1040 each include four channels, the number of channels included in each group is not limited.

The dummy group 1020 may be disposed on one side of the second source group 1030. Four source channels of each of the first source group 1040 and the second source group 1030 and four dummy channels of the dummy group 1020 may each be connected to four source channels of each of groups adjacent to the first source group 1040, the second source group 1030, and the dummy group 1020. For example, the source channels SC2877 to SC2880 of the second source group 1030 may be connected to the source channels SC2873 to SC2876 of the first source group 1040 adjacent to the second source group 1030, respectively. A source channel SC2873 may be connected to a source channel SC2877, a source channel SC2874 may be connected to a source channel SC2878, a source channel SC2875 may be connected to a source channel SC2879, and a source channel SC2876 may be connected to a source channel SC2880. In another example, the dummy channels DC1 to DC4 of the dummy group 1020 may be connected to the source channels SC2877 to SC2880 of the second source group 1030, respectively. The dummy channel DC1 may be connected to the source channel SC2877, a dummy channel DC2 may be connected to the source channel SC2878, a dummy channel DC3 may be connected to the source channel SC2879, and a dummy channel DC4 may be connected to the source channel SC2880.

In example embodiments, channels included in each of the first source group 1040, the second source group 1030, and the dummy group 1020 may be connected to source channels of an adjacent source group through a switching device, respectively. For example, the dummy channels DC1 to DC4 included in the dummy group 1020 may be connected to the source channels SC2877 to SC2880 of the second source group 1030 through switching devices SW4, SW3, SW2, and SW1, respectively. The four switching devices SW4, SW3, SW2, and SW1 may constitute a switching device group.

In example embodiments, a plurality of source channels SC2873 to SC2880 and the dummy channels DC1 to DC4 may each include at least one of a level shifter, a decoder, and an amplifier. The dummy channels DC1 to DC4 may each include the same components. For example, the dummy channels DC1 to DC4 may each include an amplifier and a decoder.

A control logic (e.g., the control logic 331 of FIG. 5) may determine whether one of a plurality of source channels is defective based on data SDATA output from amplifiers included in source channels of a plurality of source groups. For example, the control logic may determine failure of the source channel SC2873.

When failure of the source channel SC2873, which is a first source channel, is determined by the control logic, a shift register may provide pixel data groups respectively corresponding to the first source group 1040 and the second source group 1030 disposed between the first source group 1040 and the dummy group 1020 to groups adjacent to the first source group 1040 and the second source group 1030. The shift register may provide pixel data Din2873 to Din2876 respectively corresponding to the source channels SC2873 to SC2876 of the first source group 1040 to the source channels SC2877 to SC2880 of the second source group 1030 in a direction toward the dummy group 1020. For example, when failure of the source channel SC2873, which is a first source channel, is determined, the shift register may provide pixel data Din2873 corresponding to the source channel SC2873 to the source channel SC2877, provide pixel data Din2874 corresponding to the source channel SC2874 to the source channel SC2878, provide pixel data Din2875 corresponding to the source channel SC2875 to the source channel SC2879, and provide pixel data Din2876 corresponding to the source channel SC2876 to the source channel SC2880.

Also, the shift register may provide pixel data Din2877 to Din2880 respectively corresponding to the source channels SC2877 to SC2880 of the second source group 1030 to the dummy channels DC1 to DC4 of the dummy group 1020 in a direction toward the dummy group 1020.

When the dummy group 1020 is connected to the shift register and failure of the first source channel is determined, a dummy pixel data group may be provided to the first source group 1040. The shift register may provide dummy pixel data Dind1 to Dind4 respectively corresponding to the dummy channels DC1 to DC4 to the source channels SC2873 to SC2876 of the first source group 1040, respectively. For example, when failure of a first source channel is determined, the shift register may provide dummy pixel data Dint corresponding to the dummy channel DC1 to the source channel SC2873, provide dummy pixel data Din2 corresponding to the dummy channel DC2 to the source channel SC2874, provide dummy pixel data Din3 corresponding to the dummy channel DC3 to the source channel SC2875, and provide dummy pixel data Din4 corresponding to the dummy channel DC4 to the source channel SC2876.

Even when only the source channel SC2873 of the first source group 1040 is defective, all of the source channels SC2873 to SC2876 included in the first source group 1040 may use the source channels SC2877 to SC2880 included in the second source group 1030 and all of the source channels SC2877 to SC2880 included in the second source group 1030 may use the dummy channels DC1 to DC4 included in the dummy group 1020 to provide data voltages corresponding to data lines DL2873 to DL2880 respectively corresponding to source channels of the first source group 1040 and the second source group 1030.

The control logic may provide the pixel data Din2873 to Din2876 corresponding to the source channels SC2873 to SC2876 as data voltages to data lines DL2873 to DL2876 corresponding to the source channels SC2873 to SC2876 through an output path passing through the source channels SC2877 to SC2880 of the second source group 1030 adjacent to the first source group 1040. The control logic may provide the pixel data Din2877 to Din2880 corresponding to the source channels SC2877 to SC2880 as data voltages to data lines DL2877 to DL2880 corresponding to the source channels SC2877 to SC2880 through an output path passing through the dummy channels DC1 to DC4 of the dummy group 1020 adjacent to the second source group 1030.

When failure of the source channel SC2873 included in the first source group 1040 is determined, the control logic may control switching devices SW1 to SW8 to be in the turn-on state and control switching devices SW9 to SW16 to be in the turn-off state, thereby controlling an output path.

Figure 11:
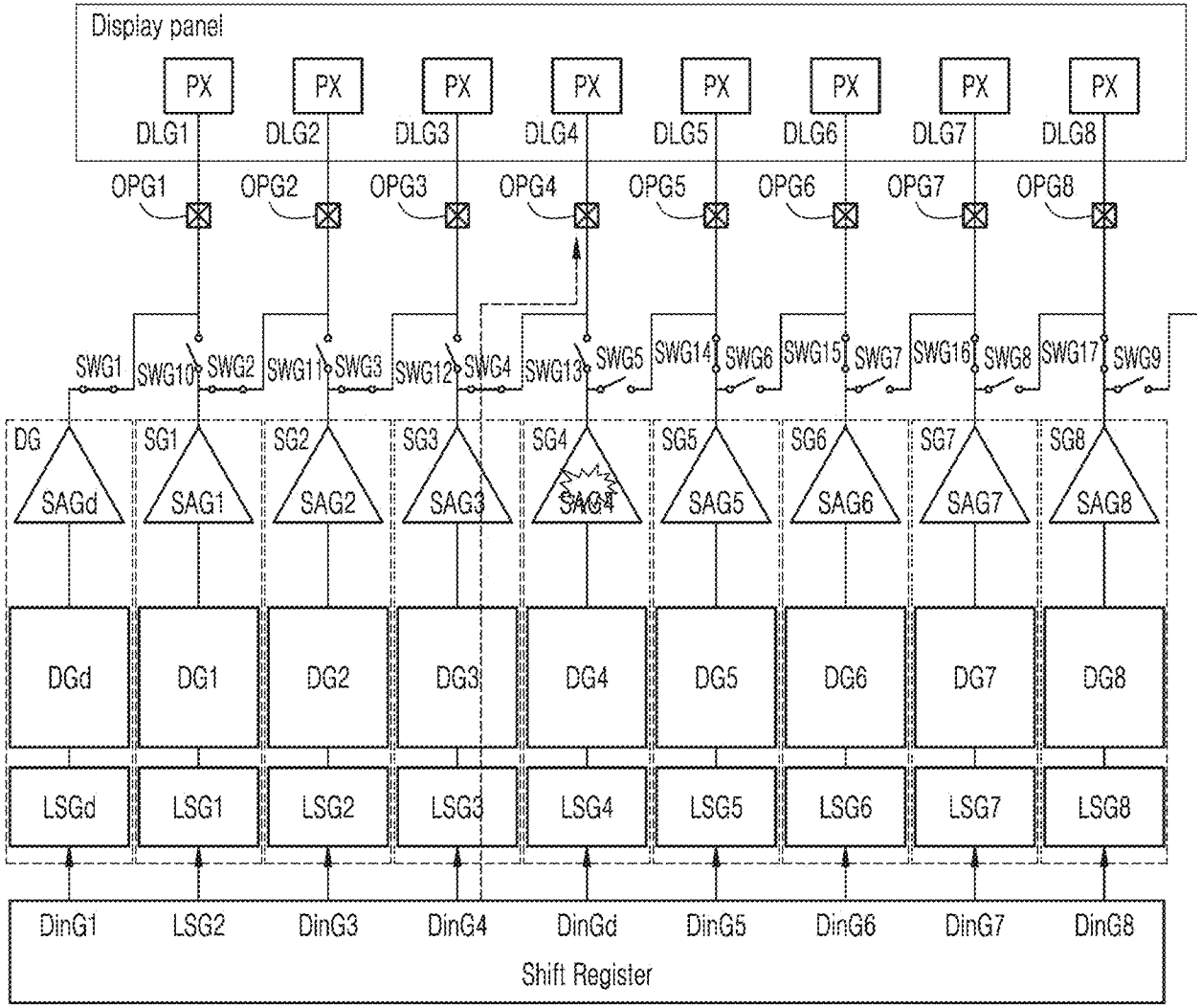
FIG. 11 is a diagram showing an example of providing data voltages by using a dummy group according to example embodiments.

FIG. 11 is a diagram showing an example of providing data voltages by using a dummy group according to example embodiments.

Referring to FIG. 11, the dummy group DG may include an amplifier group SAGd, a decoder group DGd, and a level shifter group LSGd, and the source groups SG1 to SG8 may each include amplifier groups SAG1 to SAGS, decoder groups DG1 to DG8, and level shifter groups LSG1 to LSG8. Amplifier groups, decoder groups, and level shifters group may refer to groups of a plurality of amplifiers, a plurality of decoders, and a plurality of level shifters included in a plurality of source channels included in a source group and a plurality of dummy channels included in a dummy group. A plurality of dummy channels included in the dummy group DG and a plurality of source channels included in each of the source groups SG1 to SG8 may each include a level shifter, a decoder, and an amplifier, wherein a decoder, a level shifter, and an amplifier included in each channel are connected to one another.

The locations of the switching device groups SWG1 to SWG9 may be changed according to components of dummy channels included in the dummy group DG. In example embodiments, when each of dummy channels included in the dummy group DG includes a level shifter, a decoder, and an amplifier as its components, switching devices included in each of switching device groups SWG1 to SWG8 may be connected between output pads respectively connected to source channels of a source group and output ends of amplifiers included in channels of a group adjacent to the source group, the channels respectively corresponding to the source channels of the source group. For example, switching devices included in a switching device group SWG2 may be connected between output pads respectively connected to source channels of the source group SG2 and output ends of amplifiers included in channels of the source group SG1 respectively corresponding to the source channels included in the source group SG2, and the source group SG1 may be connected to the source group SG2.

When the source group SG4 is the first source group, the control logic may control switching devices included in the switching device groups SWG1 to SWG4 and switching device groups SWG14 to SWG17 to be turned on and control switching devices included in the switching device groups SWG5 to SWG9 and switching device groups SWG10 to SWG13 to be turned off.

When the source group SG4 is the first source group, the control logic may provide data voltages to output pads of an output pad group OPG4 by transmitting pixel data of the pixel data group DinG4 corresponding to the source group SG4 through an output path passing through level shifters of channels of a level shifter group LSG3 of channels corresponding to the pixel data, decoders of a decoder group DG3 of channels corresponding to the pixel data, and amplifiers of an amplifier group SAGS of channels corresponding to the pixel data. The control logic may provide pixel data of the pixel data group DinG3 corresponding to the source group SG3 to output pads of an output pad group OPG3 as data voltages through an output path passing through source channels of the source group SG2, provide pixel data of the pixel data group DinG2 corresponding to the source group SG2 to output pads of an output pad group OPG2 as data voltages through an output path passing through source channels of the source group SG1, and provide pixel data of the pixel data group DinG1 corresponding to the source group SG1 to output pads of an output pad group OPG1 as data voltages through an output path passing through dummy channels of the dummy group DG.

Figure 12:
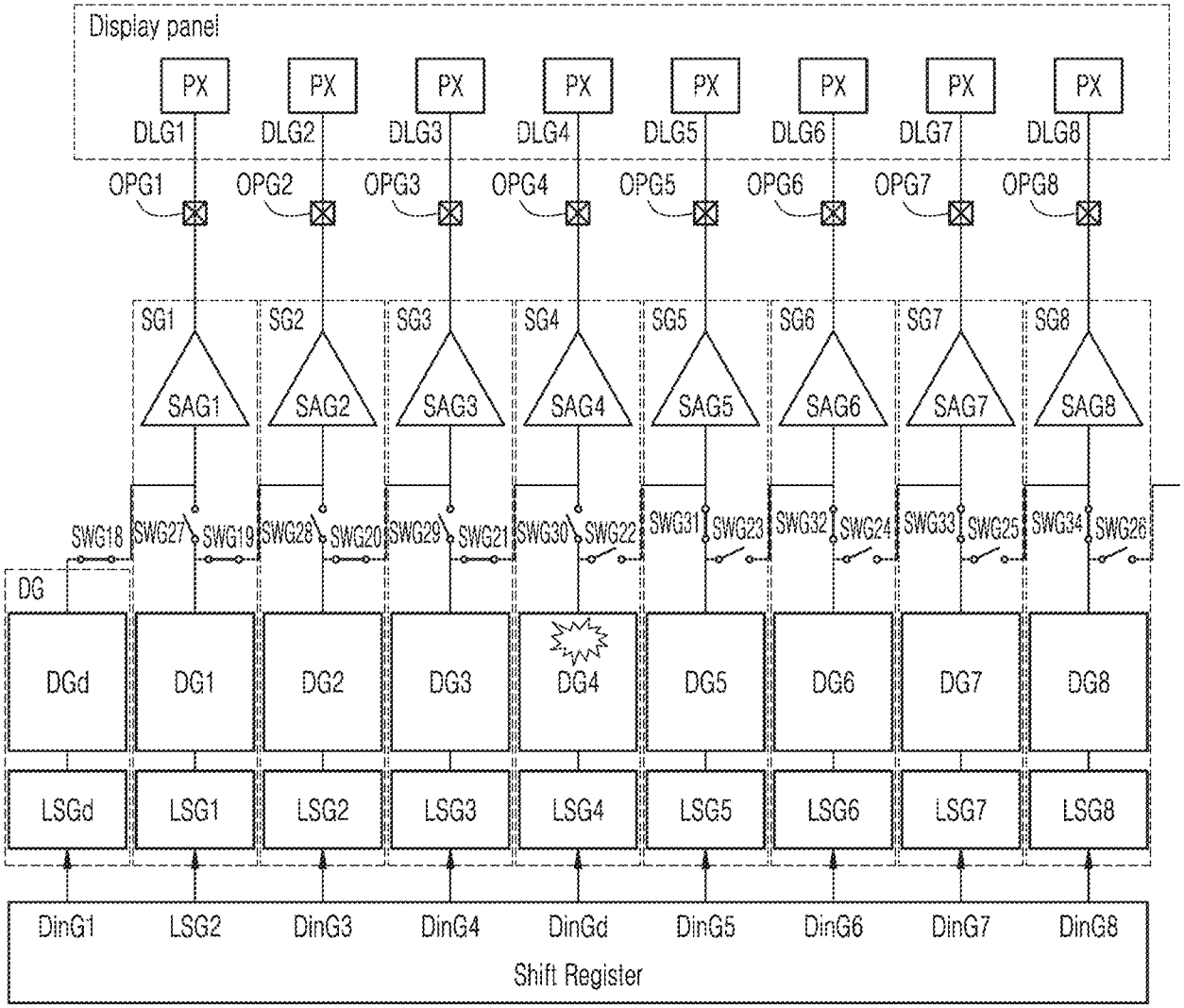
FIG. 12 is a diagram showing an example of providing data voltages by using a dummy group according to other example embodiments.

FIG. 12 is a diagram showing an example of providing data voltages by using a dummy group according to other example embodiments.

Referring to FIG. 12, the dummy group DG may include the decoder group DGd and the level shifter group LSGd. A plurality of dummy channels included in the dummy group DG may each include a level shifter and a decoder, wherein decoders and level shifters of the dummy channels are connected to one another.

The locations of the switching device groups SWG1 to SWG9 may be changed according to components of dummy channels included in the dummy group DG. In example embodiments, when each of dummy channels included in the dummy group DG includes a level shifter and a decoder as its components, switching devices included in each of switching device groups SWG18 to SWG26 may be connected between input ends of amplifiers included in source channels of a source group and output ends of decoders included in channels of a group adjacent to the source group, the channels respectively corresponding to the source channels of the source group. For example, switching devices included in a switching device group SWG18 may be connected between input ends of amplifiers include in source channels of the source group SG1 and output ends of decoders included in channels of the dummy group DG respectively corresponding to the source channels of the source group SG1, and the source group SG1 may be connected to the dummy group DG.

When the source group SG4 is the first source group, the control logic may control switching devices included in the switching device groups SWG18 to SWG21 and switching device groups SWG31 to SWG34 to be turned on and control switching devices included in the switching device groups SWG22 to SWG26 and switching device groups SWG27 to SWG30 to be turned off.

When the source group SG4 is the first source group, the control logic may provide pixel data of the pixel data group DinG4 corresponding to the source group SG4 to output pads of the output pad group OPG4 as data voltages through an output path passing through decoders and level shifters of source channels of the source group SG3 and provide pixel data of the pixel data group DinG3 corresponding to the source group SG3 to output pads of the output pad group OPG3 as data voltages through an output path passing through decoders and level shifters of source channels of the source group SG2. Also, the control logic may provide pixel data of the pixel data group DinG2 corresponding to the source group SG2 to output pads of the output pad group OPG2 as data voltages through an output path passing through decoders and level shifters of source channels of the source group SG1 and provide pixel data of the pixel data group DinG1 corresponding to the source group SG1 to output pads of the output pad group OPG1 as data voltages through an output path passing through decoders and level shifters of channels of the dummy group DG.

Figure 13:
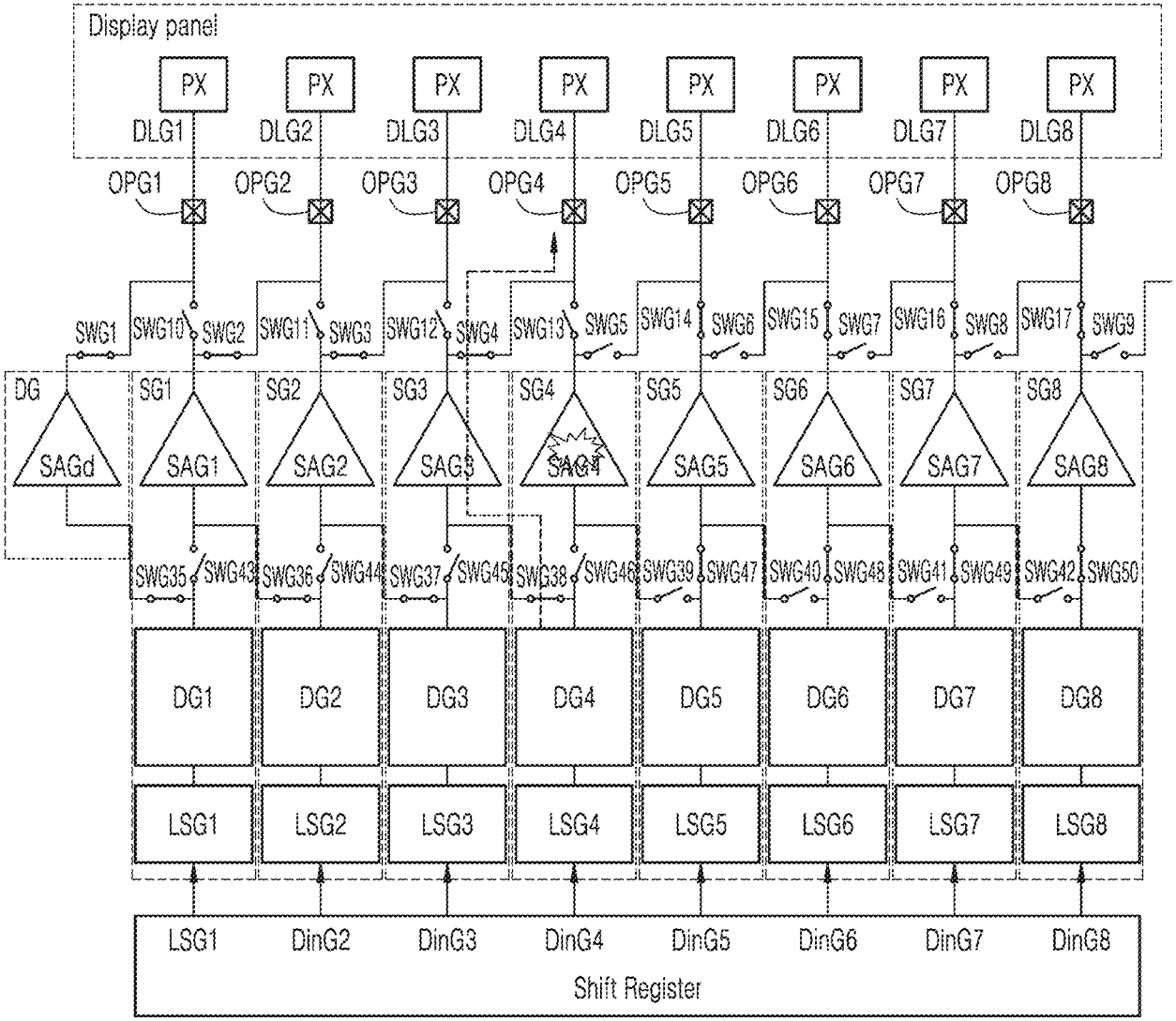
FIG. 13 is a diagram showing an example of providing data voltages by using a dummy group according to other example embodiments.

FIG. 13 is a diagram showing an example of providing data voltages by using a dummy group according to other example embodiments.

Referring to FIG. 13, the dummy group DG may include the amplifier group SAGd. A plurality of dummy channels included in the dummy group DG may include amplifiers.

The locations of the switching device groups SWG1 to SWG9 and SWG35 to SWG42 may be changed according to components of dummy channels included in the dummy group DG. In example embodiments, when each of dummy channels included in the dummy group DG includes an amplifier as its component, switching devices included in each of switching device groups SWG1 to SWG9 and SWG35 to SWG42 may include first switching devices connected between output pads respectively connected to source channels of a source channel and output ends of amplifiers included in channels of a group adjacent to the source group, the channels respectively corresponding to the source channels of the source group. The first switching devices may be included in the switching device groups SWG1 to SWG9, respectively. Also, switching devices included in the switching device groups SWG1 to SWG9 and SWG35 to SWG42 may include second switching devices connected between output ends of decoders respectively included in source channels of a source group and input ends of amplifiers in channels of a group adjacent to the source group, the channels respectively corresponding to the source channels of the source group. The second switching devices may be included in the switching device groups SWG35 to SWG42, respectively.

For example, second switching devices included in a switching device group SWG35 may be connected between output ends of decoders included in source channels of the source group SG1 and input ends of amplifiers included in channels of the dummy group DG respectively corresponding to the source channels of the source group SG1. First switching devices included in a switching device group SWG1 may be connected between output pads connected to source channels of the source group SG1 and output ends of amplifiers included in channels of the dummy group DG respectively corresponding to the source channels of the source group SG1.

When the source group SG4 is the first source group, the control logic may control, such switching devices included in the switching device groups SWG1 to SWG4, the switching device groups SWG14 to SWG17, switching device groups SWG35 to SWG38, and switching device groups SWG47 to SWG50 to be turned on and switching devices included in the switching device groups SWG5 to SWG9, the switching device groups SWG10 to SWG13, switching device groups SWG39 to SWG42, and switching device groups SWG43 to SWG46 to be turned off.

When the source group SG4 is the first source group, the control logic may provide grayscale voltages respectively output from decoders of a decoder group DG4 to output pads of the output pad group OPG4 through an output path passing through amplifiers of source channels of the source group SG3 respectively corresponding to the decoders as data voltages, respectively. The control logic may provide grayscale voltages respectively output from decoders of a decoder group DG3 to output pads of the output pad group OPG3 through an output path passing through amplifiers of source channels of the source group SG2 respectively corresponding to the decoders as data voltages, respectively. Also, the control logic may provide grayscale voltages respectively output from decoders of a decoder group DG2 to output pads of the output pad group OPG2 through an output path passing through amplifiers of source channels of the source group SG1 respectively corresponding to the decoders as data voltages, respectively, and may provide grayscale voltages respectively output from decoders of a decoder group DG1 to output pads of the output pad group OPG1 through an output path passing through amplifiers of dummy channels of the dummy group DG respectively corresponding to the decoders as data voltages, respectively.

Figure 14:
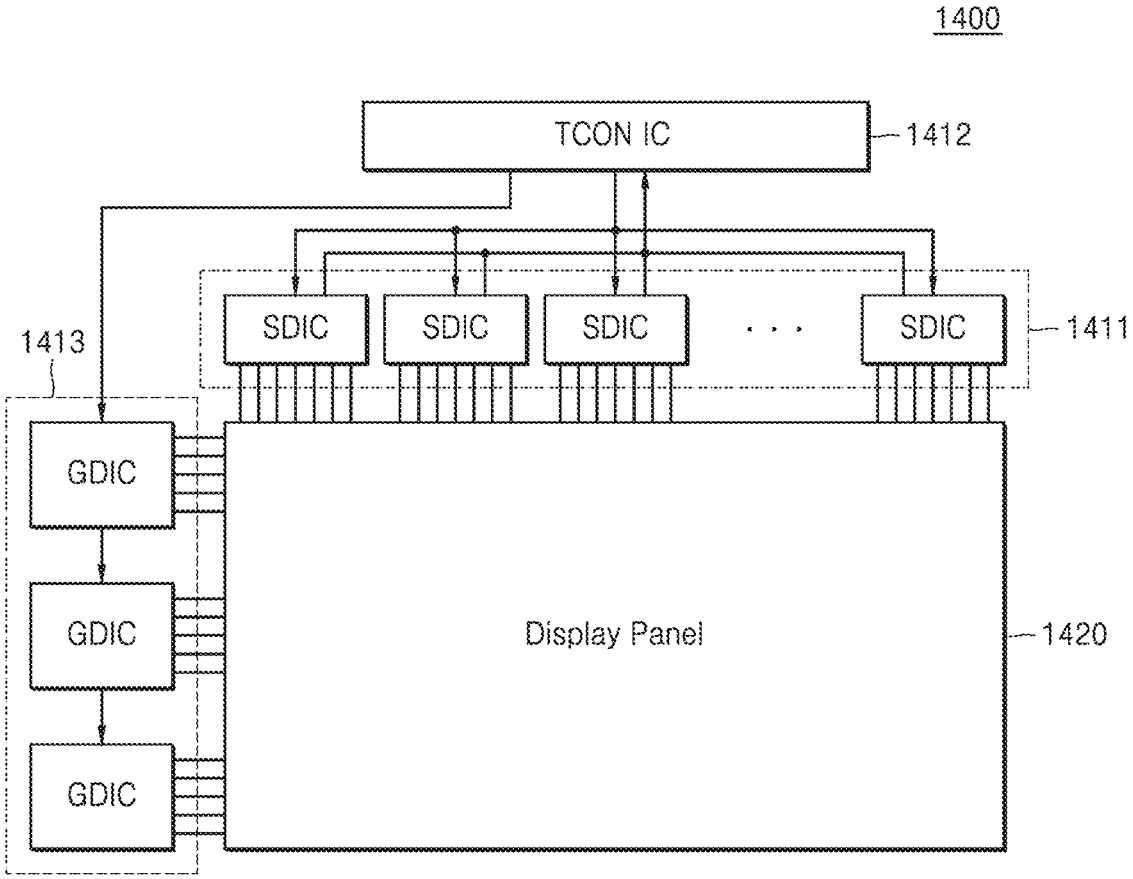
FIG. 14 is a diagram showing an example of a display device according to example embodiments of the inventive concepts.

FIG. 14 is a diagram showing an example of a display device according to example embodiments of the inventive concepts. A display device 1400 of FIG. 14 is a display device including a display panel 1420 having a mid size or a large size and may be applied to a television or a monitor, for example.

Referring to FIG. 14, the display device 1400 may include a source driver 1411, a timing controller 1412, a gate driver 1413, and/or the display panel 1420.

The timing controller 1412 may include one or more ICs or modules. The timing controller 1412 may communicate with a plurality of source driver ICs SDIC and a plurality of gate driver ICs GDIC through a set interface.

The timing controller 1412 may generate control signal for controlling driving timings for the source driver ICs SDIC and the gate driver ICs GDIC and provide the control signals to the source driver ICs SDIC and the gate driver ICs GDIC.

The source driver 1411 may include the source driver ICs SDIC, and the source driver ICs SDIC may be mounted on a circuit film like a tape carrier package (TCP), a chip on film (COF), and a flexible printed circuit (FPC) and may be attached to the display panel 1420 by using the tape automated bonding (TAB) technique or may be attached onto a non-display region of the display panel 1420 by using the chip on glass (COG) technique.

The gate driver 1413 may include the gate driver ICs GDIC, and the gate driver ICs GDIC may be mounted on a circuit film and may be attached to the display panel 1420 by using the TAB technique or may be attached onto a non-display region of the display panel 1420 by using the COG technique. Alternatively, the gate driver 1413 may be formed directly on a lower substrate of the display panel 1420 by using the gate-in-driver in panel (GIP) technique. The gate driver 1413 is formed in the non-display region of the display panel 1420 outside a pixel array in which pixels are formed and may be formed through the same TFT process as the pixels.

As described above with reference to FIGS. 1 to 14, when failure of a first source channel is determined based on the first control signal CTRL1, the source driver 1411 may provide data voltages to data lines respectively corresponding to the first source channel and second source channels, which are arranged between the first source channel and a dummy channel, by using the second source channels and the dummy channel. Therefore, even when one of a plurality of source channels is defective, data lines corresponding to the source channels may be driven by using a channel adjacent to a defective source channel, and thus a vertical line fault occurring in the display panel 1420 may be reduced or prevented.

Figure 15:
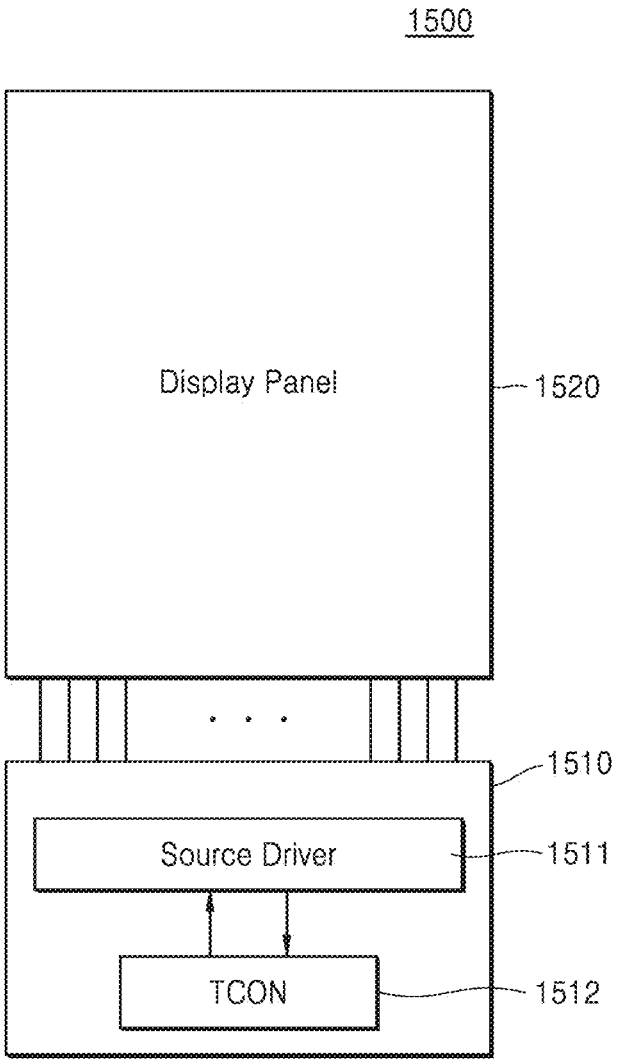
FIG. 15 is a diagram showing an example of a display device according to example embodiments of the inventive concepts.

FIG. 15 is a diagram showing an example of a display device according to example embodiments of the inventive concepts. A display device 1500 of FIG. 15 is a display device including a display panel 1520 having a small size and may be applied to mobile devices like a smartphone and a tablet PC.

Referring to FIG. 15, the display device 1500 may include a display driving circuit 1510 and/or the display panel 1520. The display driving circuit 1510 may include one or more ICs and may be mounted on a circuit film like a TCP, a COF, and an FPC and may be attached to the display panel 1520 by using the TAB technique or may be attached onto a non-display region (e.g., a region which no image is displayed) of the display panel 1520 by using the COG technique.

The display driving circuit 1510 may include a source driver 1511 and/or a timing controller 1512 and may further include a gate driver. In example embodiments, the gate driver may be mounted on the display panel 1520.

As described above with reference to FIGS. 1 to 15, when failure of a first source channel is determined based on the first control signal CTRL1, the source driver 1511 may provide data voltages to data lines respectively corresponding to the first source channel and second source channels, which are arranged between the first source channel and a dummy channel, by using the second source channels and the dummy channel. Therefore, even when one of a plurality of source channels is defective, data lines corresponding to the source channels may be driven by using a channel adjacent to a defective source channel, and thus a vertical line fault occurring in the display panel 1520 may be reduced or prevented.

One or more of the elements disclosed above may include or be implemented in control logic such as hardware including logic circuits; a hardware/software combination such as a processor executing software; or a combination thereof. For example, the control logic more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

While the inventive concepts have been particularly shown and described with reference to example embodiments thereof, it will be understood that various changes in form and details may be made therein without departing from the spirit and scope of the following claims.

What is claimed is:

1. A display driving circuit comprising:

a plurality of source channels configured to provide data voltages to a plurality of data lines of a display panel, respectively;

at least one dummy channel on one side of at least one of the source channels; and control logic configured to control operations of the source channels and the at least one dummy channel, wherein, in response to failure of a first source channel from among the source channels being determined, the control logic is further configured to provide data voltages to data lines corresponding to the first source channel and second source channels, respectively, which are between the first source channel and the at least one dummy channel, using the second source channels and the at least one dummy channel, wherein the source channels are grouped into a plurality of source groups each comprising N (N is a positive number) source channels, wherein the at least one dummy channel comprises a dummy group including N dummy channels.

2. The display driving circuit of claim 1, wherein the source channels and the at least one dummy channel are connected to adjacent channels from among the source channels, and in response to failure of the first source channel being determined, the control logic is further configured to provide data voltages to data lines corresponding to the first source channel and the second source channels, respectively, through output paths passing through at least some of channels adjacent to the first source channel and the second source channels, respectively.

3. The display driving circuit of claim 2, wherein the source channels and the at least one dummy channel are connected to adjacent source channels through switching devices respectively, and in response to the failure of the first source channel being determined, the control logic is further configured to control the output paths using the switching devices.

4. The display driving circuit of claim 1, wherein in response to failure of the first source channel included in a first source group from among the plurality of source groups being determined, the control logic is further configured to provide data voltages to data lines corresponding to source channels of the first source group and second source groups, respectively, which are between the first source group and the dummy group, by using the second source groups and the dummy group.

5. The display driving circuit of claim 4, wherein, in response to the failure of the first source channel being determined, the control logic is further configured to provide data voltages to data lines corresponding to the source channels of the first source group and the second source groups, respectively, through output paths passing through at least some of channels of groups adjacent to the first source group and the second source groups, respectively.

6. The display driving circuit of claim 5, wherein N source channels of each of the plurality of source groups and N dummy channels of the dummy group are connected to N source channels of groups adjacent to the source groups and the dummy group, respectively.

7. The display driving circuit of claim 4, wherein N is 4, and each of the plurality of source groups and the dummy group comprises at least one of a red channel, a blue channel, a first green channel, and a second green channel.

8. The display driving circuit of claim 1, wherein each of the source channels comprises:

a level shifter configured to provide a control signal by changing a voltage level of pixel data;

a decoder configured to select a grayscale voltage based on a control signal received from the level shifter; and an amplifier configured to amplify a selected grayscale voltage, wherein the control logic is further configured to determine whether a first source channel from among the source channels is defective based on an output of the amplifier.

9. The display driving circuit of claim 8, wherein the at least one dummy channel comprises at least one of the level shifter, the decoder, and the amplifier.

10. The display driving circuit of claim 8, wherein, in response to failure of a first source channel from among the source channels being determined, the control logic is further configured to provide data voltages to data lines corresponding to the first source channel and the second source channels, respectively, by using at least one of the level shifter, the decoder, and the amplifier of each of the second source channels and the at least one dummy channel.

11. The display driving circuit of claim 1, further comprising a shift register configured to provide pixel data to the source channels and the at least one dummy channel, wherein, in response to the failure of the first source channel being determined, the shift register is further configured to provide pixel data corresponding to the first source channel and the second source channels, respectively, to channels adjacent to the first source channel and the second source channels, respectively.

12. The display driving circuit of claim 11, wherein, in response to the failure of the first source channel being determined, the shift register is further configured to provide dummy pixel data corresponding to the at least one dummy channel to the first source channel.

13. A display driving circuit comprising:

a plurality of source channels in groups of N to be divided into source groups comprising N source channels, respectively;

a plurality of dummy channels in groups of N to be divided into dummy groups comprising N dummy channels, respectively;

switching devices connected between source channels of the source groups and channels of adjacent groups corresponding to the source channels of the source group, respectively; and control logic configured to, in response to at least one of the source channels being defective, provide data voltages to data lines corresponding to source channels of a first source group comprising a defective source channel through output paths passing through at least some of channels of a group adjacent to the first source group by turning on the switching devices connected to the source channels of the first source group, respectively.

14. The display driving circuit of claim 13, wherein each of the source channels and the dummy channels comprises:

a level shifter configured to provide a control signal by changing a voltage level of pixel data;

a decoder configured to select a grayscale voltage based on a control signal received from the level shifter; and an amplifier configured to amplify a selected grayscale voltage.

15. The display driving circuit of claim 14, wherein each of the source channels and the dummy channels comprises the level shifter, the decoder, and the amplifier, and the switching devices are connected between output pads connected to the source channels of the source groups, respectively and output ends of the amplifiers included in channels of a group adjacent to the source group, the channels corresponding to the source channels of the source group, respectively.

16. The display driving circuit of claim 14, wherein each of the source channels comprises the level shifter, the decoder, and the amplifier, each of the dummy channels comprises the amplifier, and the switching devices comprise:

a first switching device connected between output pads connected to the source channels of the source groups, respectively and output ends of the amplifiers included in channels of a group adjacent to the source group, the channels corresponding to the source channels of the source group, respectively; and a second switching device connected between output ends of the decoders included in the source channels of the source group and input ends of the amplifiers included in channels of a group adjacent to the source group, the channels corresponding to the source channels of the source group, respectively.

17. The display driving circuit of claim 14, wherein each of the source channels comprises the level shifter, the decoder, and the amplifier, wherein each of the dummy channels comprises the level shifter and the decoder, and the switching devices are connected between input ends of amplifiers included in the source channels of a source group and output ends of the decoders included in channels of a group adjacent to the source group, the channels corresponding to the source channels of the source group, respectively.

18. A display device comprising:

a display panel; and a display driving circuit configured to drive the display panel to display images on the display panel, wherein the display driving circuit comprises:

a plurality of source channels configured to provide data voltages to a plurality of data lines of the display panel, a dummy channel on one side of at least one of the source channels; and control logic configured to control operations of the source channels and the dummy channel, and wherein in response to failure of a first source channel from among the source channels being determined, the control logic is further configured to provide data voltages to data lines corresponding to the first source channel and second source channels, respectively, which are between the first source channel and the dummy channel, by using the second source channels and the dummy channel, wherein the source channels include a plurality of source groups each comprising N (N is a positive number) source channels, and wherein the dummy channel comprises a dummy group including N dummy channels.

19. The display device of claim 18, wherein the source channels and the dummy channel are connected to adjacent channels from among the source channels, and in response to failure of the first source channel is determined, the control logic being further configured to provide data voltages to data lines corresponding to the first source channel and the second source channels, respectively through output paths passing through at least some of channels adjacent to the first source channel and the second source channels.

20. The display device of claim 18, wherein in response to failure of the first source channel included in a first source group from among the source groups being determined, the control logic is further configured to provide data voltages to data lines corresponding to source channels of the first source group and second source groups, respectively, which are between the first source group and the dummy group, by using the second source groups and the dummy group.

* * * * *